US011253884B2

(12) United States Patent
Doyle

(10) Patent No.: US 11,253,884 B2
(45) Date of Patent: Feb. 22, 2022

(54) DEVICE FOR CLEANING AND DRYING A SPRAYING UNIT

(71) Applicant: Circle Dynamics, Inc., Ontario (CA)

(72) Inventor: James Laurence Doyle, Ontario (CA)

(73) Assignee: Circle Dynamics, Inc., Peterborough (CA)

( * ) Notice: Subject to any disclaimer, the term of this patent is extended or adjusted under 35 U.S.C. 154(b) by 0 days.

(21) Appl. No.: 16/466,189

(22) PCT Filed: Dec. 9, 2016

(86) PCT No.: PCT/CA2016/051455

§ 371 (c)(1),
(2) Date: Jun. 3, 2019

(87) PCT Pub. No.: WO2018/102907

PCT Pub. Date: Jun. 14, 2018

(65) Prior Publication Data

US 2020/0147633 A1 May 14, 2020

(51) Int. Cl.
*B05B 15/55* (2018.01)
*B05B 15/555* (2018.01)
(Continued)

(52) U.S. Cl.
CPC ..... *B05B 15/555* (2018.02); *B05B 15/55* (2018.02); *B08B 3/02* (2013.01); *B05B 13/0405* (2013.01);
(Continued)

(58) Field of Classification Search
CPC ..... B08B 3/02; B08B 3/006; B05B 15/55; B05B 15/555; B05B 15/557; B05B 15/02;
(Continued)

(56) References Cited

U.S. PATENT DOCUMENTS 4,934,393 A 6/1990 Lighthall et al.
4,977,911 A 12/1990 Vetter et al.
(Continued)

FOREIGN PATENT DOCUMENTS

CA 2507043 A1 9/2004
CA 2866038 A1 4/2015
(Continued)

OTHER PUBLICATIONS

International Search Report for PCT/CA2016/051455 completed Aug. 10, 2017.
(Continued)

*Primary Examiner* — Mikhail Kornakov
*Assistant Examiner* — Richard Z. Zhang
(74) *Attorney, Agent, or Firm* — Langer, Grogan and Diver P.C.; Joseph F. Murphy

(57) ABSTRACT

A device for cleaning and drying a spraying unit, the device containing: a top end and a bottom end; the top and bottom end connected to each other by a housing; the housing having an opening proximate the top end, for receiving at least a portion of a spraying unit; a first liner within the housing; a second liner within the first liner; the first liner fitting within the housing forming a space between an outside wall of the first liner and an inside wall of the housing; the second liner fitting within the first liner forming a space between an outside wall of the second liner and an inside wall of the first liner; the opening further containing an open cap, proximate the top end; the device having at least one vacuum air supply influent port, at least one drying air supply influent port and at least one solvent supply influent port.

25 Claims, 26 Drawing Sheets

(51) Int. Cl.

| | |
|---|---|
| ***B08B 3/02*** | (2006.01) |
| *B05B 14/49* | (2018.01) |
| *B05B 13/04* | (2006.01) |
| *B08B 15/02* | (2006.01) |

(52) U.S. Cl.
CPC ..... *B05B 14/49* (2018.02); *B08B 15/026* (2013.01); *B08B 2203/0229* (2013.01)

(58) Field of Classification Search
CPC ..... B05B 15/023; B05B 15/026; B05B 13/04; B05B 13/0405; B05B 15/50–58
See application file for complete search history.

(56) References Cited

U.S. PATENT DOCUMENTS

| | | | | |
|---|---|---|---|---|
| 5,174,317 | A | 12/1992 | Robb et al. | |
| 5,693,150 | A | 12/1997 | Powell | |
| 7,597,767 | B1 * | 10/2009 | Fathbruckner | B05B 15/55 134/21 |
| 2015/0097051 | A1 * | 4/2015 | Jessup | B05B 15/555 239/112 |
| 2018/0369852 | A1 * | 12/2018 | Pettit | B05B 14/49 |
| 2019/0344302 | A1 * | 11/2019 | Jessup | B08B 7/04 |

FOREIGN PATENT DOCUMENTS

| | | | |
|---|---|---|---|
| CN | 101537400 | A * | 9/2009 |
| EP | 0230245 | A2 | 7/1987 |
| EP | 0230245 | A3 | 7/1987 |
| EP | 1338347 | A2 | 6/2003 |

OTHER PUBLICATIONS

European Search Report dated Jun. 26, 2020.
Certificate of Correction of U.S. Pat. No. 5,693,150.
Abstract of CN105127037A.
Abstract of CN10537400B.

* cited by examiner

DEVICE FOR CLEANING AND DRYING A SPRAYING UNIT

FIELD OF THE DISCLOSURE

This disclosure relates to a device for cleaning and drying a spraying unit, in particular, for cleaning a paint-spraying unit. A component of the cleaning and drying device may also be retrofitted into existing cleaning and drying devices.

BACKGROUND

Typical cleaning devices for cleaning a spraying unit include a single solvent stream and a single air stream. The solvent stream is used to remove unwanted material from the spraying unit and the air is used to assist in further removal of unwanted material and dry the cleaned spraying unit. In some instances, the exhaust from the cleaning devices comprise significant liquids and volatile organic compounds ("VOCs"). Some cleaning devices do not effectively clean and dry the spraying unit with water borne products on the spraying unit. Some cleaning devices experience residue caking on the inner walls thereof and retaining of dirt resulting in inefficiency of the cleaning devices as well as increased down time for maintenance and cleaning of the devices. In some instances, attempts to clean the cleaning devices of caked on residue and dirt further blocks the solvent recovery system of the cleaning devices. Existing/Currently available cleaning devices have stationary air outlets. There is a need for a cleaning and drying device that reduces residue caking. There is a need for a cleaning and drying device that includes directional and/or adjustable air outlets or air outlets that may accommodate varying air directions and/or flow pattern. There is a need for a cleaning and drying device that includes directional and/or adjustable solvent outlets or solvent outlets that may accommodate varying solvent directions and/or flow pattern. There is a need for a cleaning and drying device that reduces the potential of unwanted material to adhere to the outside surfaces as well as the exhaust passage and further areas that are inaccessible to cleaning a surface of a cleaning and drying device. There is a need for a cleaning and drying device which reduces liquids and VOCs from the exhaust thereof. There is a need for a component of a cleaning and drying device that may be retrofitted into existing cleaning/drying devices.

SUMMARY

According to one aspect, there is provided a device for cleaning and drying a spraying unit, preferably a paint-spraying unit, more preferably a paint outlet of a paint spraying unit, said device comprising:

a top end and a bottom end;

said top and bottom end connected to each other by a housing;

said housing having an opening proximate said top end, for receiving at least a portion of a spraying unit;

a first liner, in exemplary embodiments a first funnel, within said housing;

a second liner, in exemplary embodiments a second funnel, within said first liner, preferably within said first funnel;

said first liner fitting within said housing forming a first space, in exemplary embodiments a first annular space, between an outside wall of said first liner and an inside wall of said housing;

said second liner fitting within said first liner forming a second space, in exemplary embodiments a second annular space, between an outside wall of said second liner and an inside wall of said first liner;

said opening further comprising an open cap, in exemplary embodiments an open annular (or ring-shape) cap, proximate the top end, preferably proximate a perimeter of said top end;

said device, in exemplary embodiments said open cap, having at least one vacuum air supply influent port, at least one drying air supply influent port and at least one solvent supply influent port, at least one vacuum air supply channel in communication with said at least one vacuum supply influent port, for supplying vacuum air to at least one vacuum air effluent port; at least one drying air supply channel, in communication with said at least one drying air supply influent port, for supplying drying air to at least one drying air effluent port; in exemplary embodiments said at least one drying air effluent port being adjustable in flow direction of said drying air; at least one solvent supply channel in communication with said at least one solvent supply influent port, for supplying solvent to at least one solvent effluent port; in exemplary embodiments said at least one solvent effluent port being adjustable in flow direction of said solvent; in exemplary embodiments said at least one drying air supply influent port, said at least one solvent supply influent port and said at least one vacuum air supply influent port being separated from each other;

said at least one vacuum air effluent port for providing air along the outside wall of said second liner, in exemplary embodiments along said first annular space, allowing said air provided by said at least one vacuum air effluent port to flow in a direction away from said top end and towards said bottom end creating a vacuum (negative pressure) within the device for drawing air (and preferably solvent) through the top end of said device in a direction away from said top, down along the inside wall of said second liner; in exemplary embodiments further drawing air up through the space formed between the outside wall of said second liner and inside wall of said first liner, in exemplary embodiments along said second annular space, and down through the space formed between the outside wall of said first liner and inside wall of said housing, in exemplary embodiments along said first annular space, out through the bottom end of said device, said vacuum for drawing material and solvent towards and out a drain proximate said bottom end;

said at least one drying air effluent port for providing air proximate said opening of said device, in exemplary embodiments allowing air to flow in a direction towards a centre of said opening and preferably towards said bottom end;

said at least one solvent effluent port for providing solvent proximate said top of said device, in exemplary embodiments allowing said solvent to flow in a direction towards a centre of said opening and towards said bottom end.

In one embodiment, said device comprises a plurality of vacuum air effluent ports.

In another embodiment, said device comprises a plurality of drying air effluent ports.

In another embodiment, said device comprises a plurality of solvent effluent ports.

In an exemplary embodiment, said at least one air effluent port is proximate said annular (ring-shaped) cap.

In an exemplary embodiment, said at least one solvent effluent port is proximate said annular (ring-shaped) cap.

In an exemplary embodiment, each of said plurality of air effluent ports proximate said annular (ring-shaped) cap alternate with each of said plurality of solvent effluent ports proximate said annular (ring-shaped) cap; in exemplary embodiments, each of said plurality of air effluent ports are separated from each of said plurality of solvent effluent ports, by a wall.

In yet another embodiment, each of said plurality of air effluent ports proximate said annular (ring-shape) cap are above each of said plurality of solvent effluent ports proximate said annular (ring-shaped) cap.

In yet another embodiment, each of said air effluent ports are contained within an air block such as a removable air block.

In yet another embodiment, each of said solvent effluent ports are contained within a solvent block, preferably a removable solvent block.

In an exemplary embodiment, said housing is hexagonal in shape.

In an exemplary embodiment, said first liner is dodecagonal conical in shape.

In an exemplary embodiment, said second liner is dodecagonal conical in shape.

In exemplary embodiments, said dodecagonal conical in shape second liner further comprises at least one vane, preferably a plurality of spaced apart vanes, preferably vertically oriented along the inside of said inner wall of said second liner. Preferably said at least one vane, preferably said plurality of vanes, is a flat longitudinal shape.

In another embodiment, at least one surface, preferably a plurality, of said device is smooth, for reducing adherence of unwanted product, solvent or combinations thereof to a surface of said device.

In another embodiment, at least one surface, preferably a plurality, of said device is treated, for reducing adherence of unwanted product, solvent or combinations thereof to a surface of said device. In exemplary embodiments, said at least one surface is treated with Teflon™ or equivalent.

In yet another embodiment, there is provided a cleaning, drying and vacuum element for use with an existing cleaning and drying device having an opening, said element comprising:

i) an open cap such as an annular (ring-shape) cap;

ii) a cone shaped funnel attached to said open cap; said open cap further comprising at least one vacuum air supply influent port, at least one drying air supply influent port and at least one solvent supply influent port, at least one vacuum air supply channel in communication with said at least one vacuum supply influent port, for supplying vacuum air to at least one vacuum air effluent port; at least one drying air supply channel, in communication with said at least one drying air supply influent port, for supplying drying air to at least one drying air effluent port; at least one solvent supply channel in communication with said at least one solvent supply influent port, for supplying solvent to at least one solvent effluent port;

said at least one vacuum air effluent port for providing air to flow in a direction away from said open cap and towards a bottom end of said cleaning device resulting in a vacuum within the device for drawing air through the top end of said device in a direction away from said top, down along an inside wall of said cone shaped funnel; said vacuum for drawing material and solvent towards and out a drain proximate said bottom end;

said at least one drying air effluent port for providing air proximate said opening of said device, in exemplary embodiments allowing air to flow in a direction towards said bottom end;

said at least one solvent effluent port for providing solvent proximate said top of said device, in exemplary embodiments allowing said solvent to flow in a direction towards said bottom end.

In exemplary embodiments, the material of construction of said device is selected from stainless steel, coated steel, aluminum and combinations thereof.

DETAILED DESCRIPTION

Figure 1:
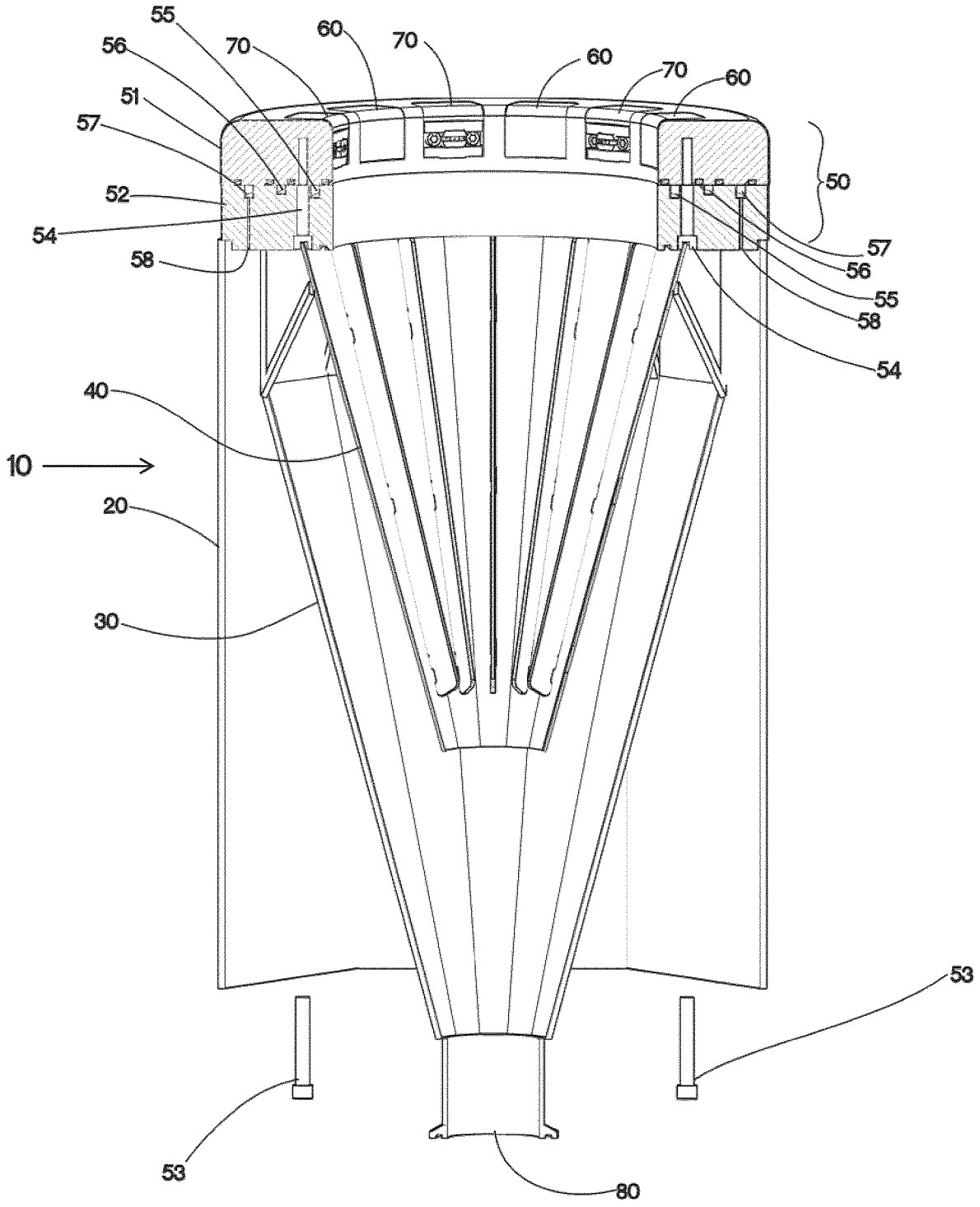
FIG. 1 is a cross sectional view of the cleaning and drying device according to one embodiment.

Referring now to FIG. 1, there is provided a cross section of the cleaning and drying device generally depicted as 10. The cleaning and drying device 10 comprises a housing 20 being a hexagonally shaped tube, a first liner 30 being a dodecagonal shaped funnel within said housing 20, a second liner 40 being a dodecagonal shaped funnel within said first liner 30. The housing 20, first liner 30 and second liner 40 have at the top end thereof an annular (ring-shape) cap 50 with an opening for insertion and removal of a spraying unit (not shown) requiring cleaning and subsequent drying. The annular (ring shape) cap 50 includes a plurality of air blocks 60 and solvent blocks 70 along the inner diameter thereof. In this embodiment, the air blocks 60 alternate with the solvent blocks 70, and each are separated from each other by a wall portion of cap 50. Each of solvent blocks 70 provide solvent to the cleaning and drying device 10, and in particular, in a direction and flow towards the centre of the opening formed by the annular ring 50 and towards the bottom of the cleaning and drying device 10, in order to direct any unwanted product cleaned from the spraying unit (and used solvent) towards the drain 80 of the first liner 30 (although the drain may be part of the second liner and/or the housing). Each of air blocks 60 provides drying air to the cleaning and drying device 10, and in particular, in a direction and flow towards the centre of the opening and towards the bottom of the cleaning and drying device 10 in order to dry the cleaned spraying unit and direct any residual unwanted product cleaned from the spraying unit and/or any residual solvent towards the drain 80 of the first liner 30 (although the drain may be part of the second liner and/or the housing). The annular ring/cap 50, in this embodiment, comprises an upper plate 51 and a lower plate 52. Upper plate 51 and lower plate 52 are fastened together with a plurality of plate fasteners, although any fastening method known to a person of ordinary skill may be used. In this instance, the plate fasteners are a series of stainless steel socket cap screws 53 received in cap screw receivers 54. Each of cap screw receivers 54 have an upper plate portion and a lower plate portion. Upper plate 51 and lower plate 52, when fastened together, form a series of conduits (channels) running along the inside of cap ring 50. Air conduit 55 serves to provide air to each of said air blocks 60. Solvent conduit 56 serves to provide solvent to each of said solvent blocks 70. Vacuum conduit 57 serves to provide vacuum air to each vacuum air port 58.

Figure 2:
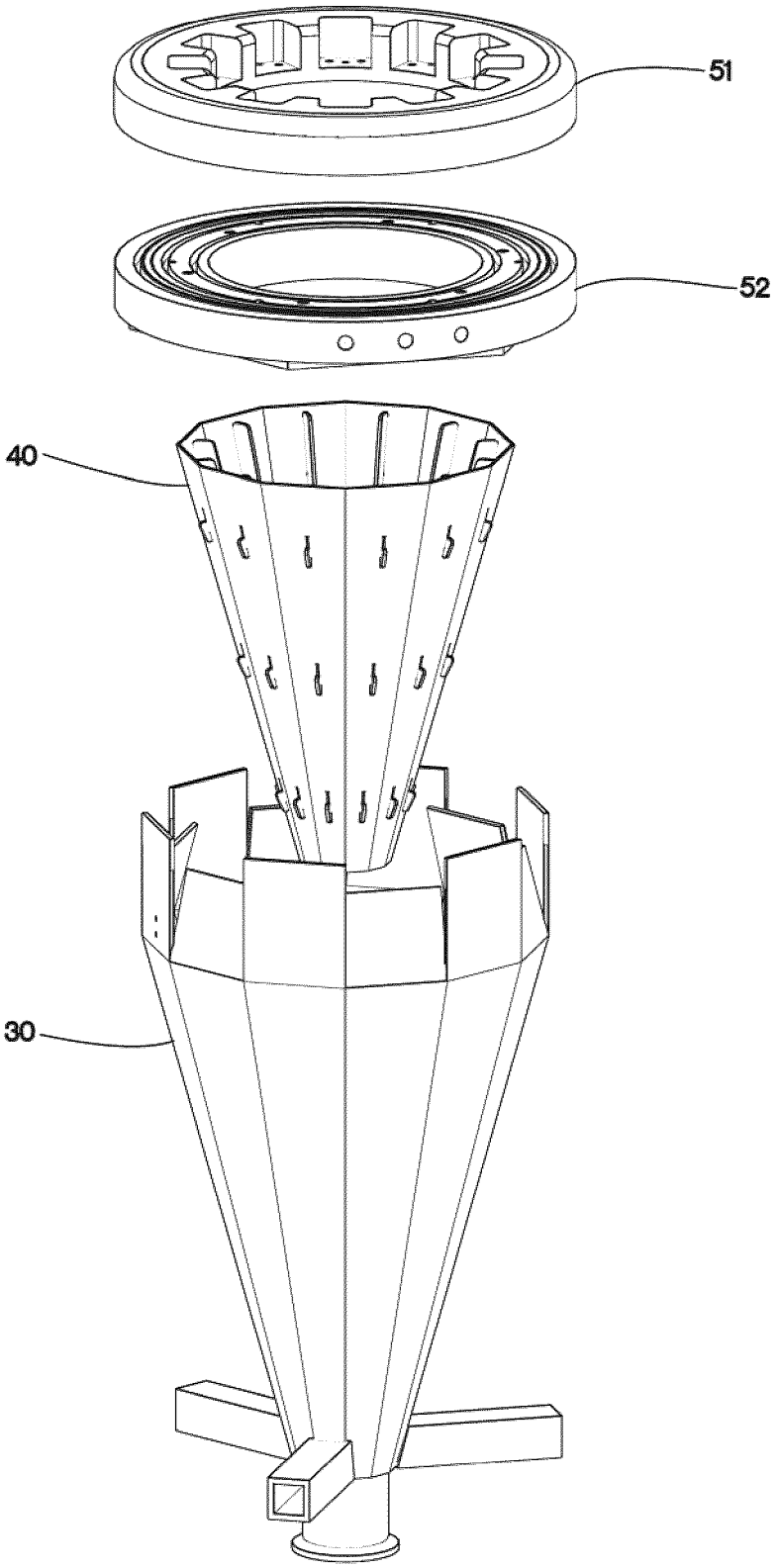
FIG. 2 is an exploded view of the cleaning and drying device of FIG. 1 without the housing.

Referring now to FIG. 2, an exploded view of the cleaning and drying device 10 showing the upper plate 51, lower plate 52, first liner 30 and second liner 40. In this embodiment, the first liner 30 and second liner 40 are cone-like and dodecagonal in shape. The cone-like shape denotes the smooth tapering from a top end to a bottom end, with each of the first liner 30 and second liner 40 tapering down towards the drain 80. The dodecagonal shape denotes the shape of the walls of each of the first liner 30 and the second liner 40.

Figure 3:
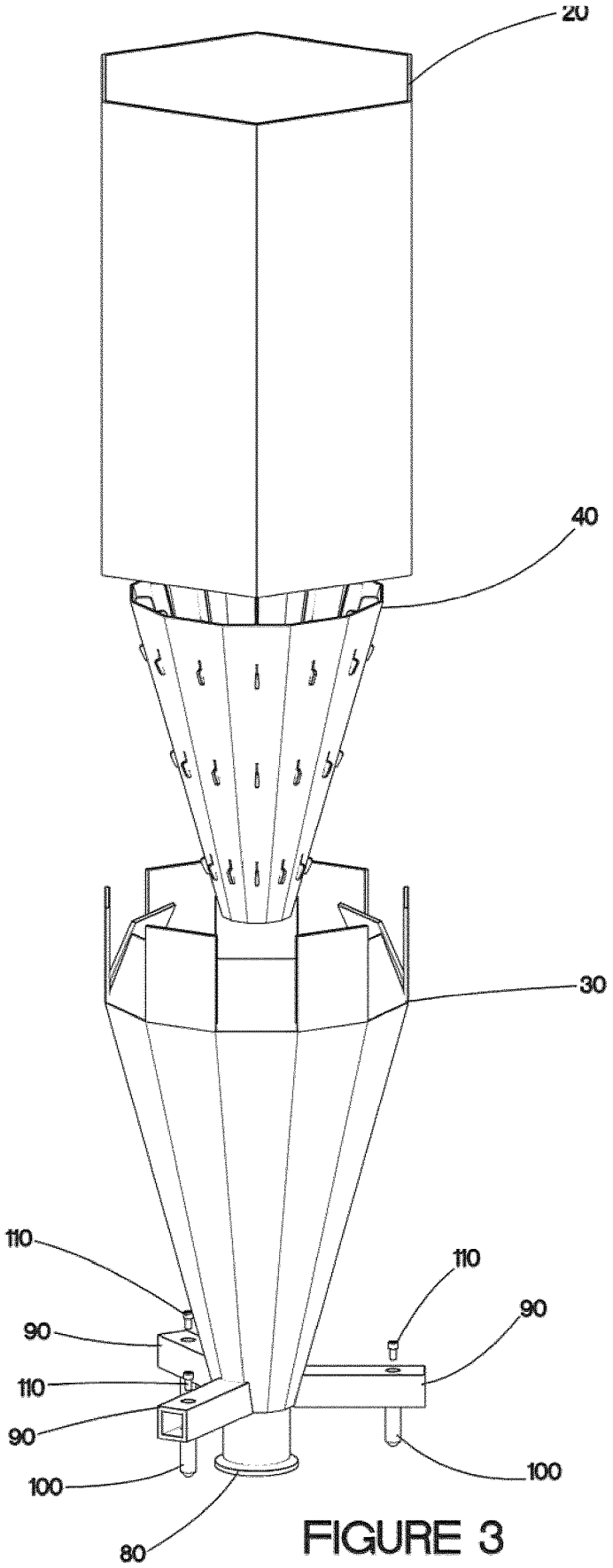
FIG. 3 is an exploded view of the cleaning and drying device of FIG. 1 without the annular (ring-shape) cap.

Referring now to FIG. 3, an exploded view of the cleaning and drying device 10 showing the housing 20 along with the first liner 30 and second liner 40. In this embodiment, a plurality of base arms 90 located near the drain 80 extend radially outward from the drain 80. Each base arm 90 at an end distant the drain 80, further comprises a leg 100 extending normally downward from each base arm 90 and parallel to a central axis of said drain 80. Each leg 100 is held securely in place to said respective base arm 90 by a leg pin 110. Each end of leg 100 distant the base arm 90 fits into a leg end receiver (not shown) of a base (not shown).

Figure 4:
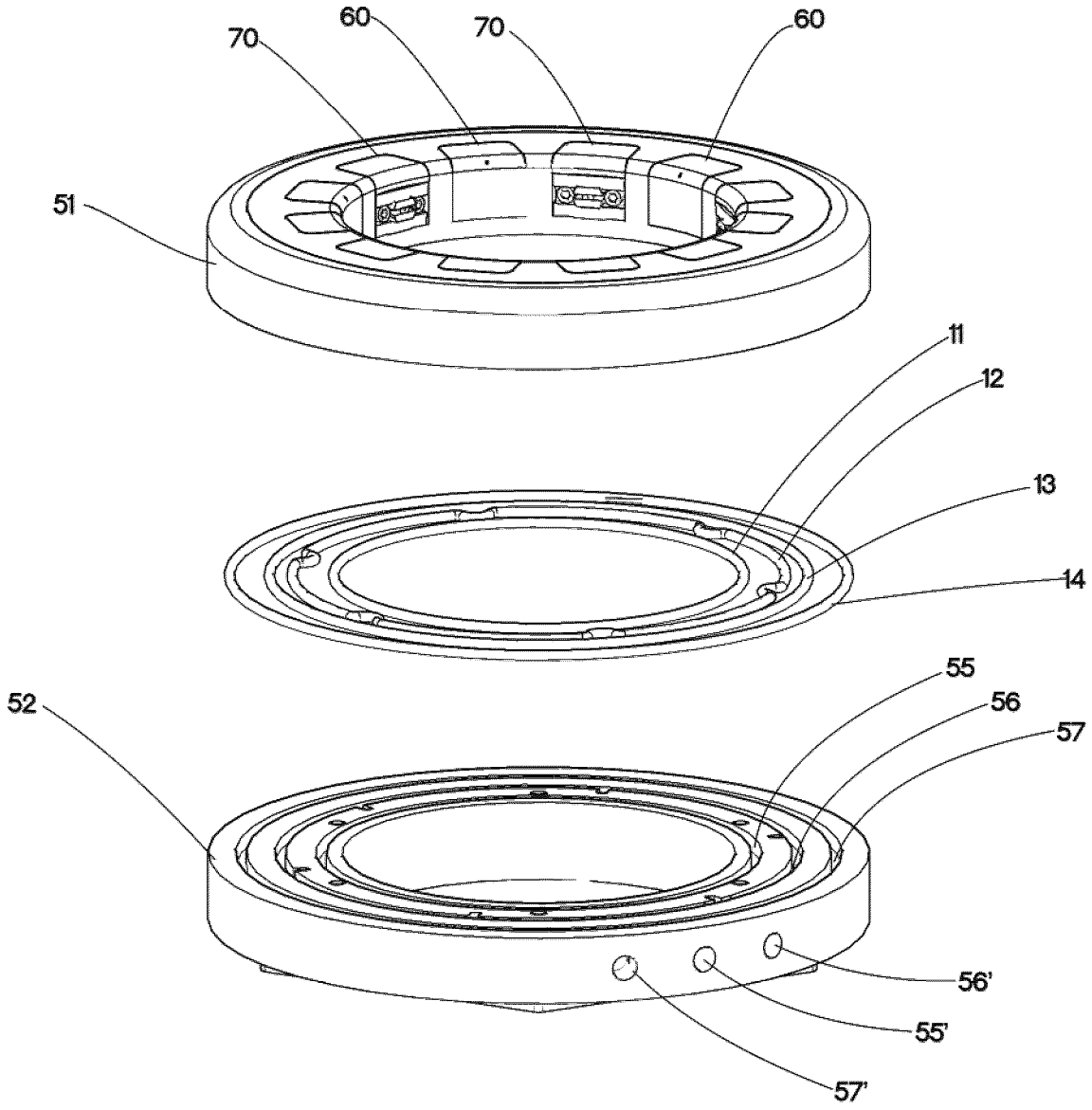
FIG. 4 is an exploded view of the annular (ring-shape) cap with several components depicted according to one embodiment.
Figure 5A:
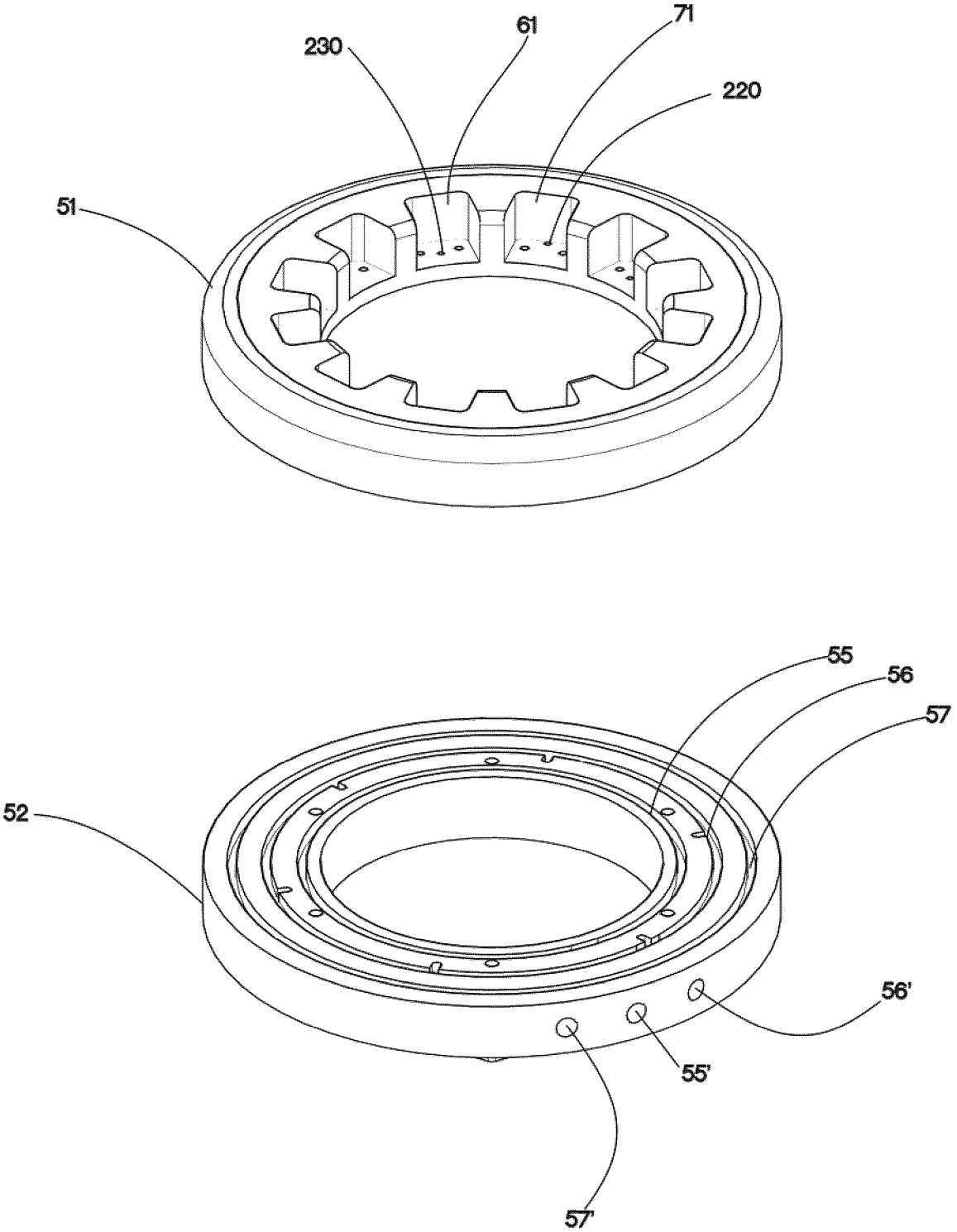
FIG. 5A is a top exploded view of the annular (ring-shape) cap according to one embodiment.
Figure 5B:
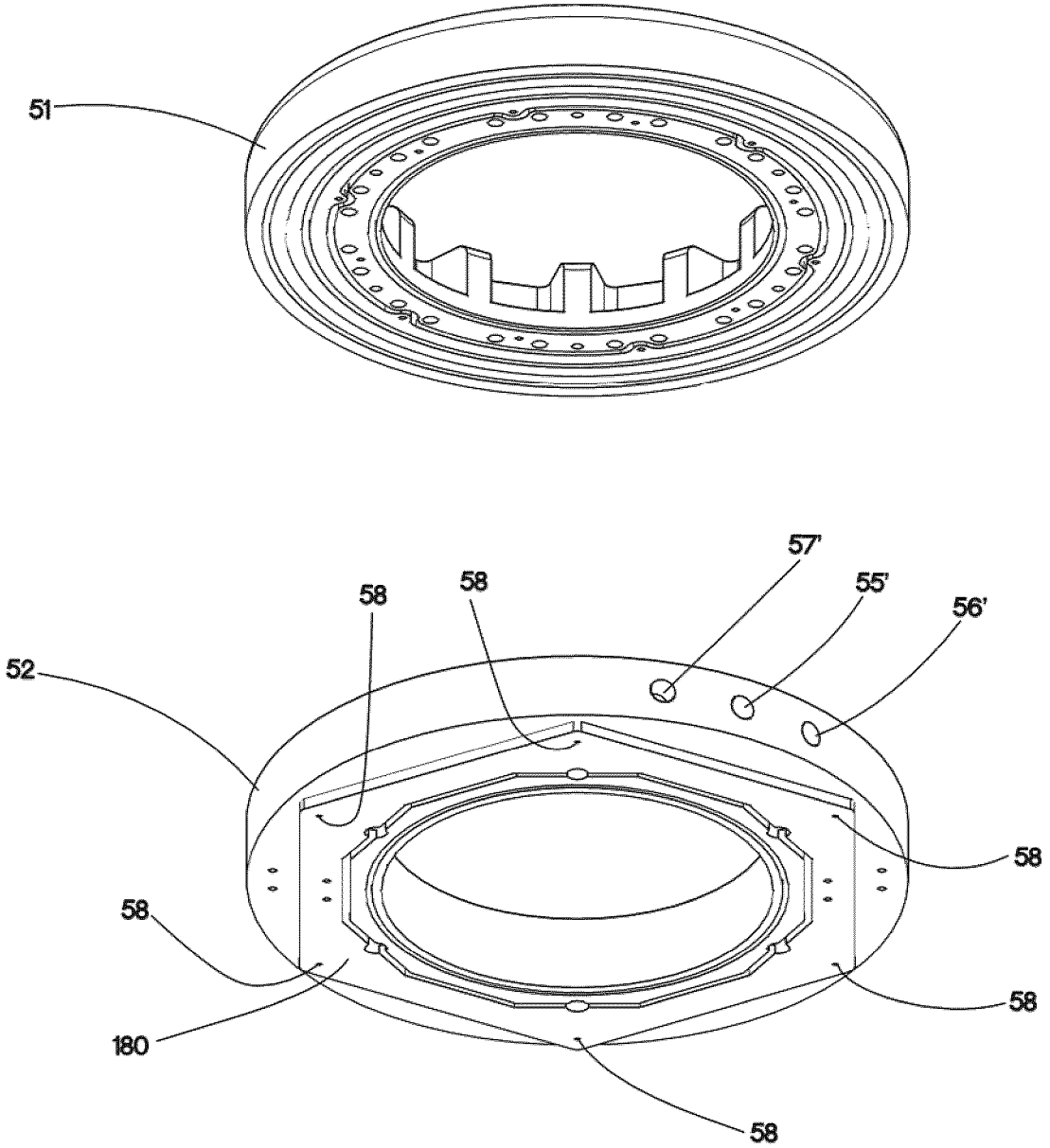
FIG. 5B is a bottom exploded view of the annular (ring-shape) cap according to one embodiment.

Referring now to FIGS. 4, 5A and 5B an exploded view of the annular ring 50 depicting the upper plate 51, lower plate 52, air conduit channel 55 for connecting to air supply port 55', solvent conduit channel 56 for connecting to solvent supply port 56', vacuum conduit channel 57 for connecting to vacuum supply port 57'. Each channel 55, 56 and 57 is separated from each other, preferably by a wall, to prevent bleed over and is situated along the length of the annular ring 50. To assist in preventing bleed over, a gasket, preferably a resilient gasket, preferably a plurality of gaskets, is provided between each channel. The gasket is secured in place when the upper plate 51 is secure to the lower plate 52. In this instance, first ring shaped gasket 11, maintains a seal between air conduit channel 55 and the opening of said device 10; second ring shaped gasket 12, maintains a seal between air conduit channel 55 and solvent conduit channel 56; third ring shaped gasket 13 maintains a seal between solvent conduit channel 56 and vacuum air conduit channel 57; and fourth ring shaped gasket 14 maintains a seal between vacuum air conduit channel 57 and the outside of said device 10. Along the inner diameter of the annular ring 50 are the air blocks 60 alternating with the solvent blocks 70.

Figure 5C:
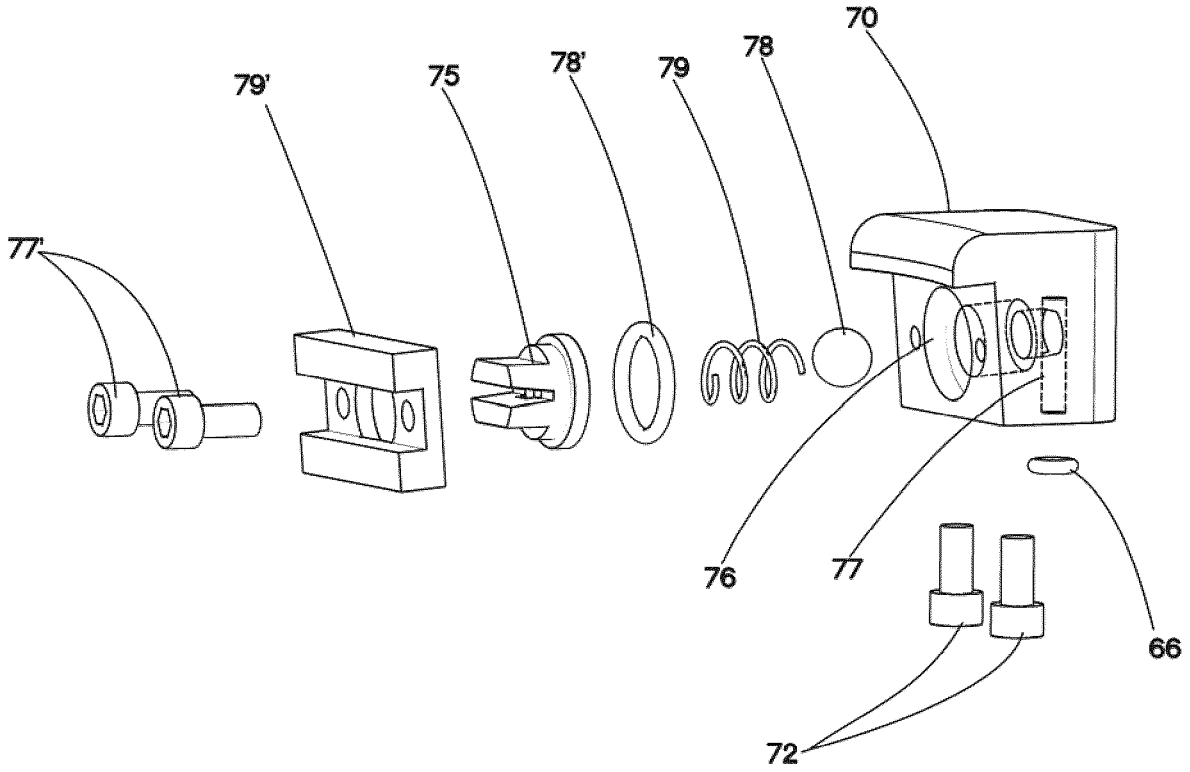
FIGS. 5C and 5D are exploded views of the solvent block according to one embodiment.
Figure 5D:
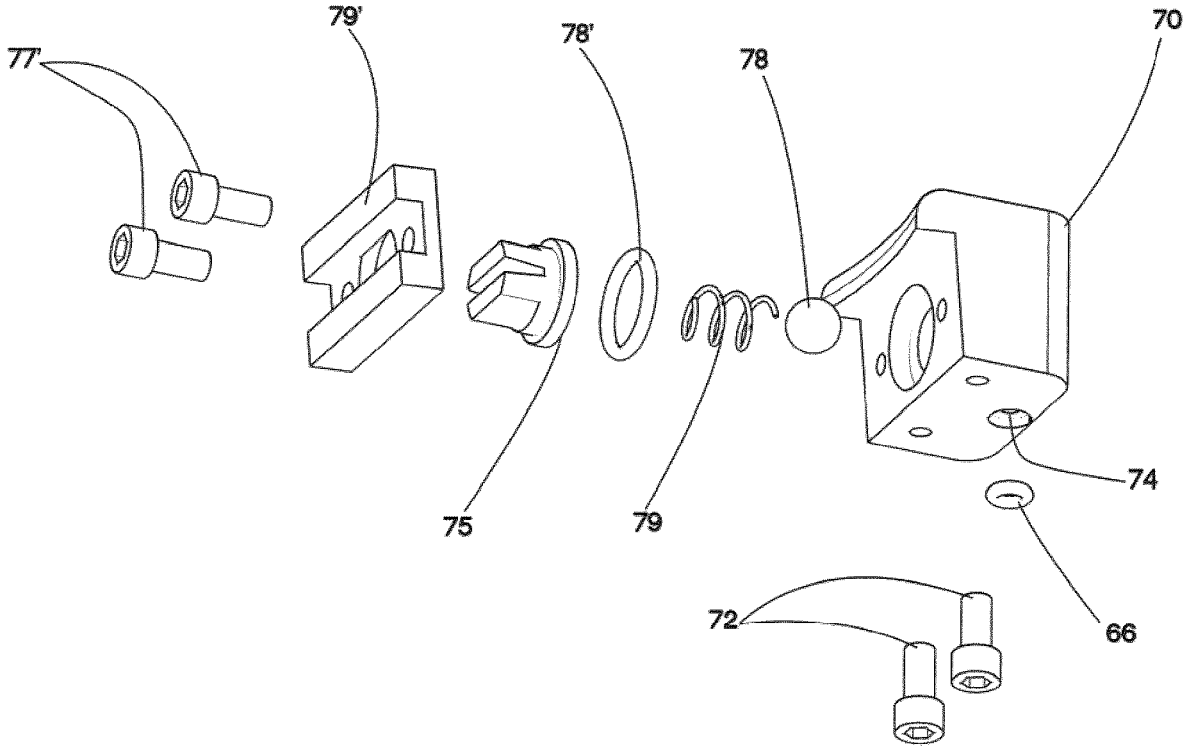

FIGS. 5A and 5B show the vacuum air supply port 57', drying air supply port 55' and solvent supply port 56', to supply vacuum air, drying air and solvent respectively to the cleaning and drying device 10. Vacuum air supply port 57' is in communication with vacuum channel 57 and vacuum outlet ports 58. Drying air supply port 55' is in communication with air conduit channel 55 and air supply aperture 64 and air block nozzle 65 of each air block 60 (see FIGS. 5E and 5F). Solvent supply port 56' is in communication with solvent conduit channel 56 and solvent feed aperture 74 and solvent block nozzle 75 of each solvent block 70 (FIGS. 5C and 5D). Also depicted are solvent block receivers 71 to receive solvent blocks 70 and air block receivers 61 to receive air blocks 60, alternating one with each other. Each solvent block receiver 71 and air block receiver 61 being separated by a wall. Each solvent block receiver 71 and air block receiver 61 have a solvent feed aperture 220 and air feed aperture 230, respectively, to feed solvent to a solvent block 70 (see FIGS. 5C and 5D) and air to an air block 60 (see FIGS. 5E and 5F). The lower portion of the upper plate 51 depicts a plurality of gasket channels to receive gaskets to keep air and solvent channels separate and avoid bleeding.

Figure 5E:
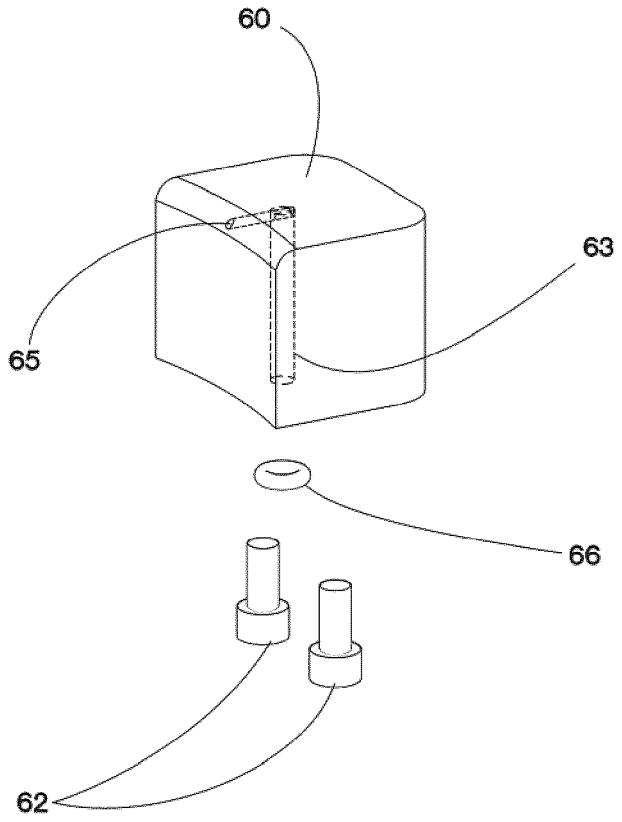
FIGS. 5E and 5F are exploded views of the air block according to one embodiment.
Figure 5F:
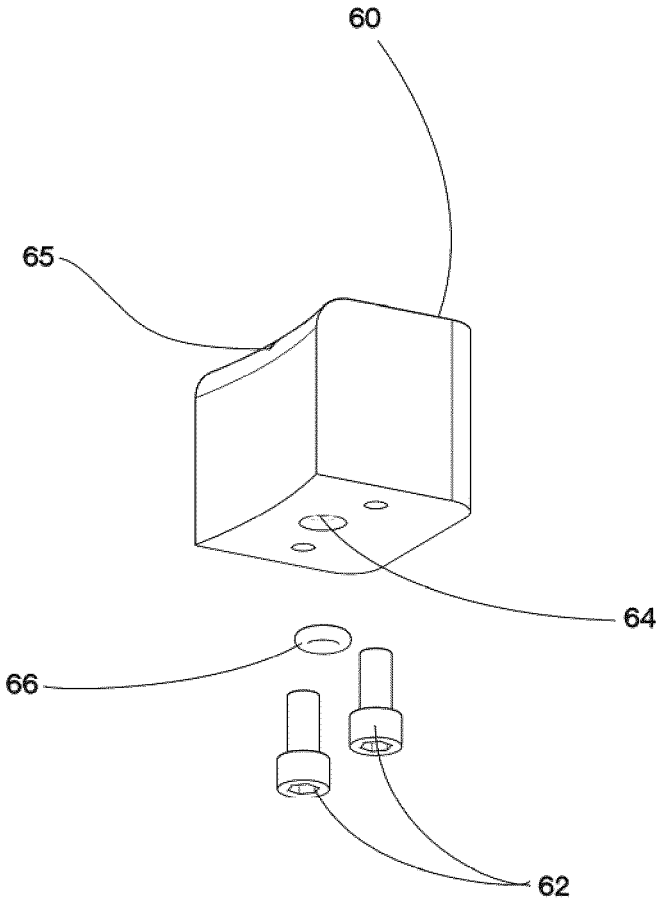

Referring now to FIGS. 5A, 5C-5G, each air block 60 is matingly received and fastened into a complementary air block receiver 61 with an air block fastener. In this instance the air block fastener is a pair of stainless steel socket cap screws 62 (FIGS. 5E-5F). Each solvent block 70 is matingly received and fastened into a complementary solvent block receiver 71 with a solvent block fastener. In this instance the solvent block fastener is a pair of stainless steel socket cap screws 72 (FIGS. 5C-5D). Each air block 60 is separated from each solvent block 70 by a separator wall 140 (although this is optional). Although the air blocks 60 and solvent blocks 70 could also be integral with the annular (ring shape) cap 50, the modularity of the blocks facilitates repair and replacement of each block, if required, without requiring replacement of the entire annular (ring shape) cap 50 and all blocks.

FIGS. 5C and 5D depict solvent block 70 comprising a block shape with a solvent block channel 77 running along the inside of the solvent block 70 connecting the solvent feed aperture 74 on the annular ring 50 to the solvent block nozzle 75. In a preferred embodiment, solvent block nozzle 75 is matingly received into solvent block 70 via a recessed solvent block nozzle-receiving portion 76. Between the solvent block nozzle receiving portion 76 and the solvent block nozzle 75 is a check ball 78 then a spring 79 against said check ball 78. The check ball 78 and spring 79 help maintain a seal when solvent flow is not needed. The solvent block channel-receiving portion 76 then receives a solvent nozzle seal, in this embodiment a solvent nozzle o-ring 78' to assist in ensuring solvent flow is restricted to the solvent block nozzle 75. A retainer plate 79' is provided to retain solvent block nozzle 75, solvent nozzle o-ring 78', spring 79 and solvent check ball 78 in said receiving portion 76. The retainer plate 79' is "C" shaped with a centrally located aperture allowing the nozzle 75 to perform as required. The retainer plate 79' is held in place with two stainless steel socket cap screws 77'. The solvent nozzle 75 has a solvent nozzle stream wall 75' which is angled based on the desired solvent spray pattern for certain applications. For example, the angle of the solvent nozzle stream wall 75' may be, but not limited to, 0 to 90 degrees from centre, preferably from 30 to 60 degrees from centre. In an alternative embodiment, the solvent nozzle is adjustable and may be adjusted within the solvent block 70 to adjust solvent spray pattern as desired. Further, volume of solvent may be controlled by orifice size in a flow restrictor which may be mounted proximate or at the solvent supply port 56' at the lower plate 52 of the cap 50. Alternatively solvent supply port 56' may have a predetermined orifice size to control volume of solvent as desired.

FIGS. 5E and 5F depict air block 60 comprises a block shape with an air channel 63 connecting the air supply hole 64 on the annular (ring shape) cap 50 to the air block nozzle 65. Air block 60 is secured in place on upper plate 51 via two stainless steel socket cap screws 62. Air block nozzle 65 may be adjustable to modify air flow pattern and air flow volume as desired. Although the angle of air block nozzle 65 to air channel 63 is 90 degrees in this depiction, the angle may be adjusted to adjust flow direction and flow pattern as desired. Air nozzle angle may be, but not limited to, from 0 to 90 degrees from centre, preferably from 0 to 15 degrees from centre.

Each solvent block 70 and air block 60 include a resilient o-ring gasket 66 for a tight seal against the upper plate 51 and minimize bleeding of air or solvent.

Figure 5G:
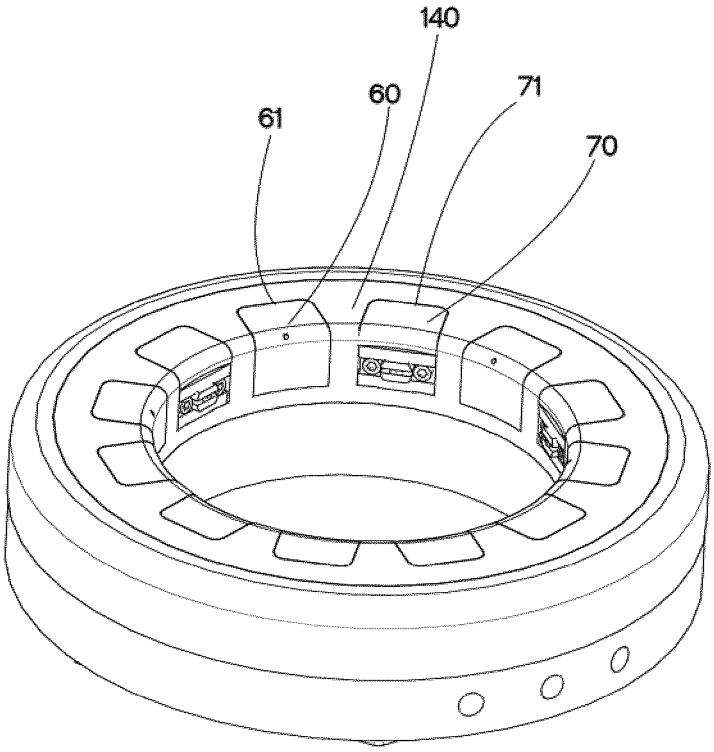
FIG. 5G is a view of depicts the assembled annular cap of FIGS. 4, 5A 5F.

FIG. 5G depicts the annular ring (top cap) 50 when assembled with the alternating air blocks 60 and solvent blocks 70 secured in place.

Figure 6A:
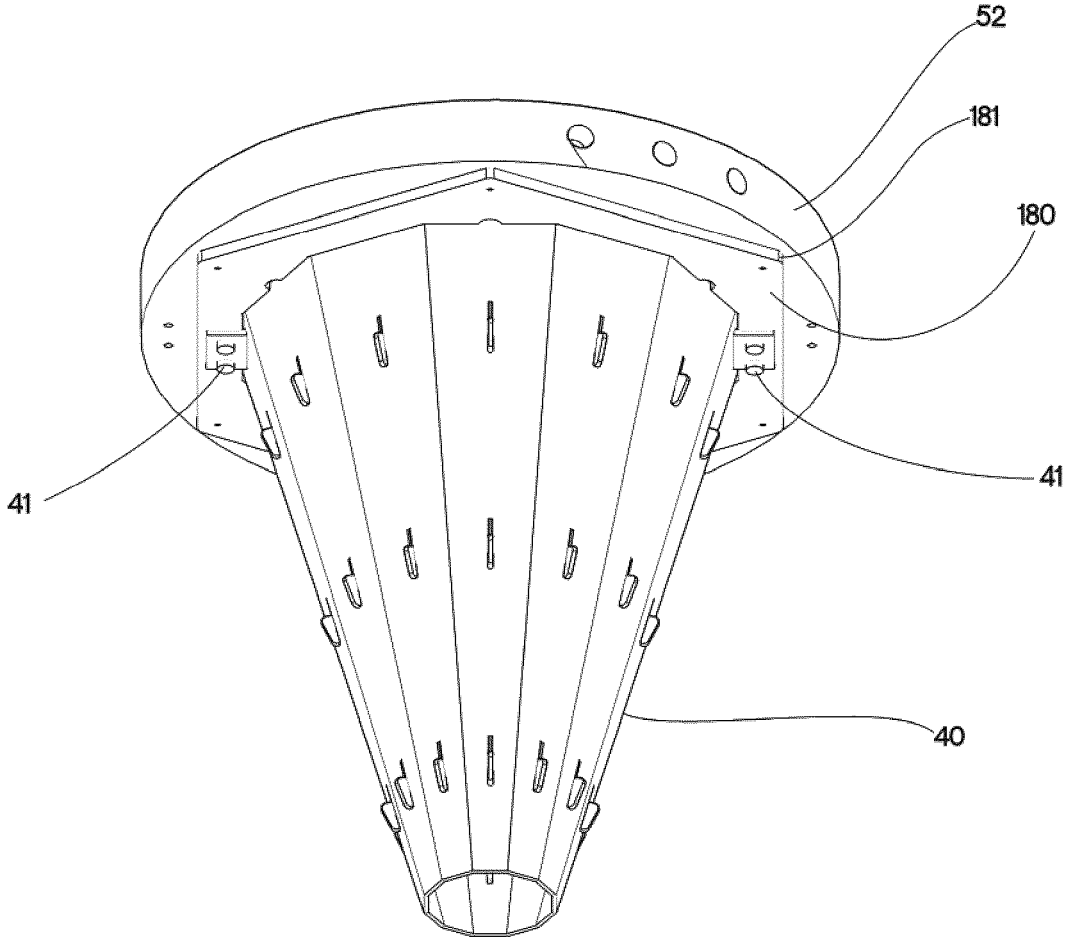
FIG. 6A is a view of the second liner attached to the bottom plate of the annular (ring-shape) cap according to one embodiment.

FIG. 6A depicts the lower plate 52 attached to the second liner 40 via second liner fastener 41. In this case two stainless steel cap screws fasten liner 40 to the bottom of the lower plate 52. As best seen in FIGS. 5B and 6A, lower plate 52 includes a hexagonal plate 180 on the bottom thereof that serves to engage with lower plate receiver 190 (FIG. 6B) of the first liner 30. Each portion of the hexagonal plate 180 formed by a portion proximate each vertex 181 of the hexagonal plate 180 is received in each lower plate receiver 190. Each lower plate receiver 190 is formed by a portion of every other side of the dodecagonal shaped first liner 30. This provides a firm fit of the annular ring 50 with the first liner 30. Proximate each vertex of the hexagonal plate 180 is a vacuum air supply aperture to provide air into the housing such that a vacuum is created towards the bottom end of the unit, drawing solvent, air and any product or material cleaned off the cleaning unit.

Figure 6B:
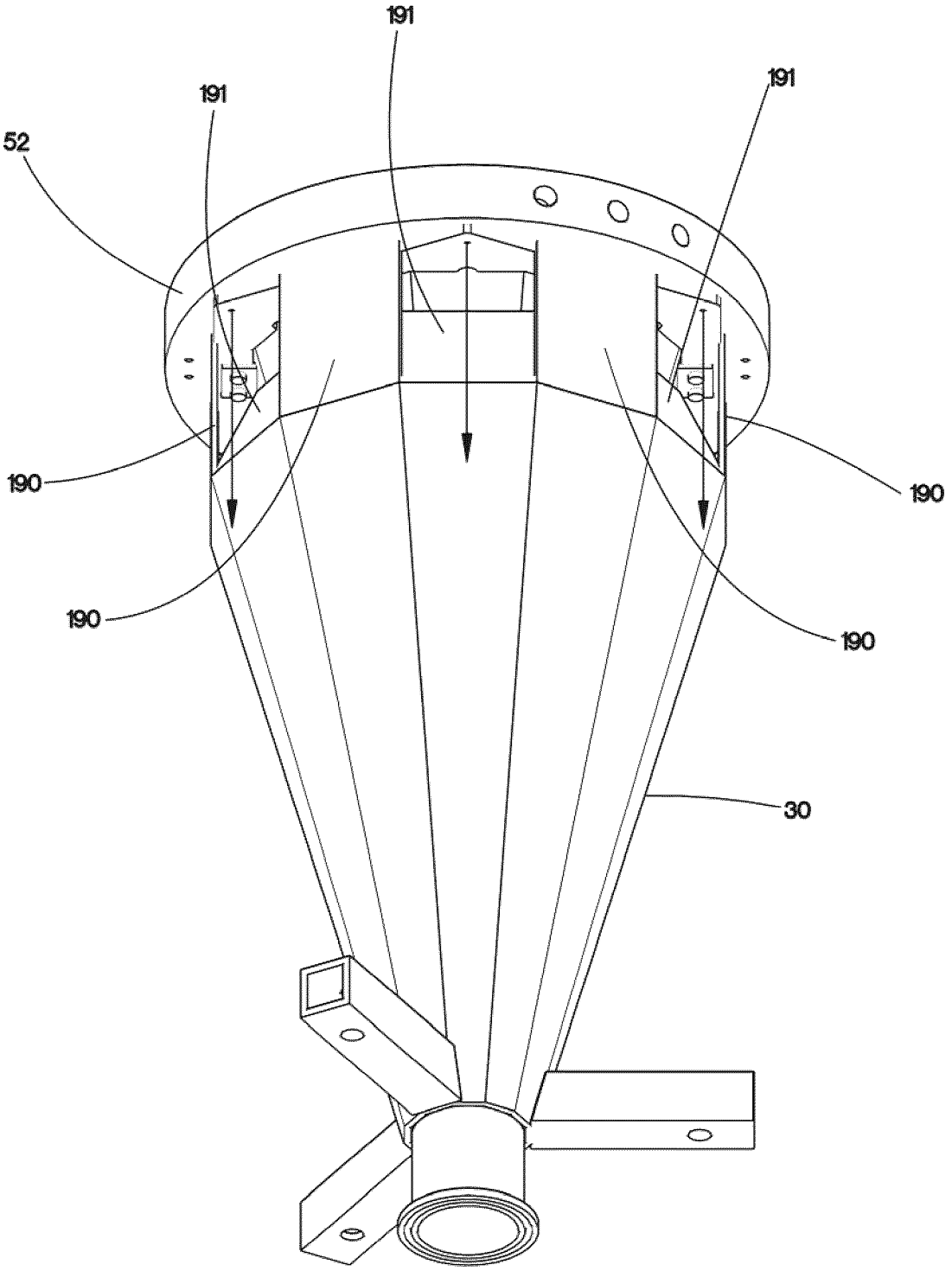
FIG. 6B is a view of the first liner over the second liner attached to the bottom plate of the annular (ring-shape) cap according to one embodiment.

FIG. 6B depicts the first liner 30 fit over the second liner 40 (not seen). In this figure, vacuum air is shown being blown downwards along the outside wall of the first liner at six locations 58 from the lower plate 52 (only three locations visible).

Figure 6C:
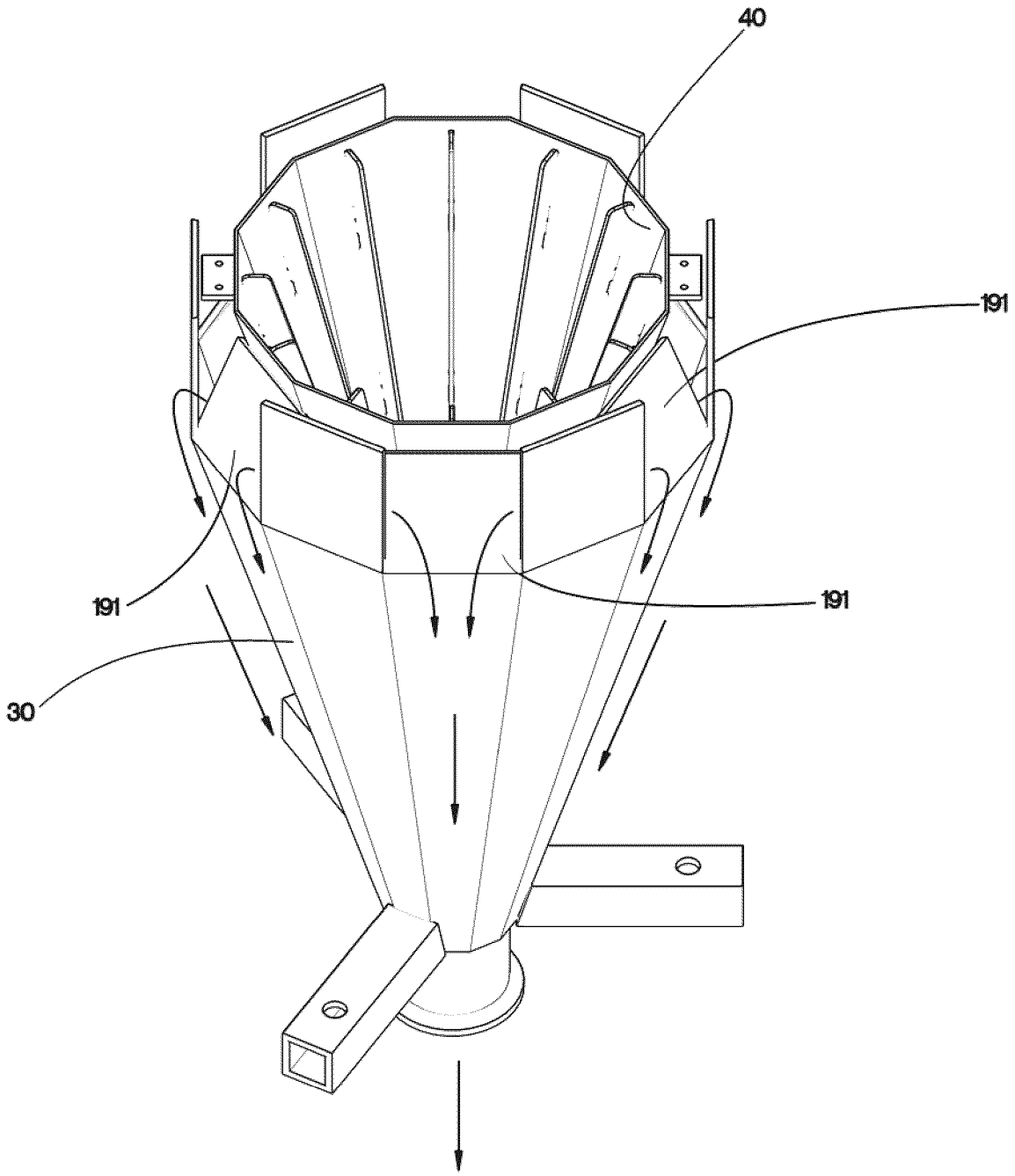
FIG. 6C is a view of the first and second liner and the air flow according to one embodiment.
Figure 6D:
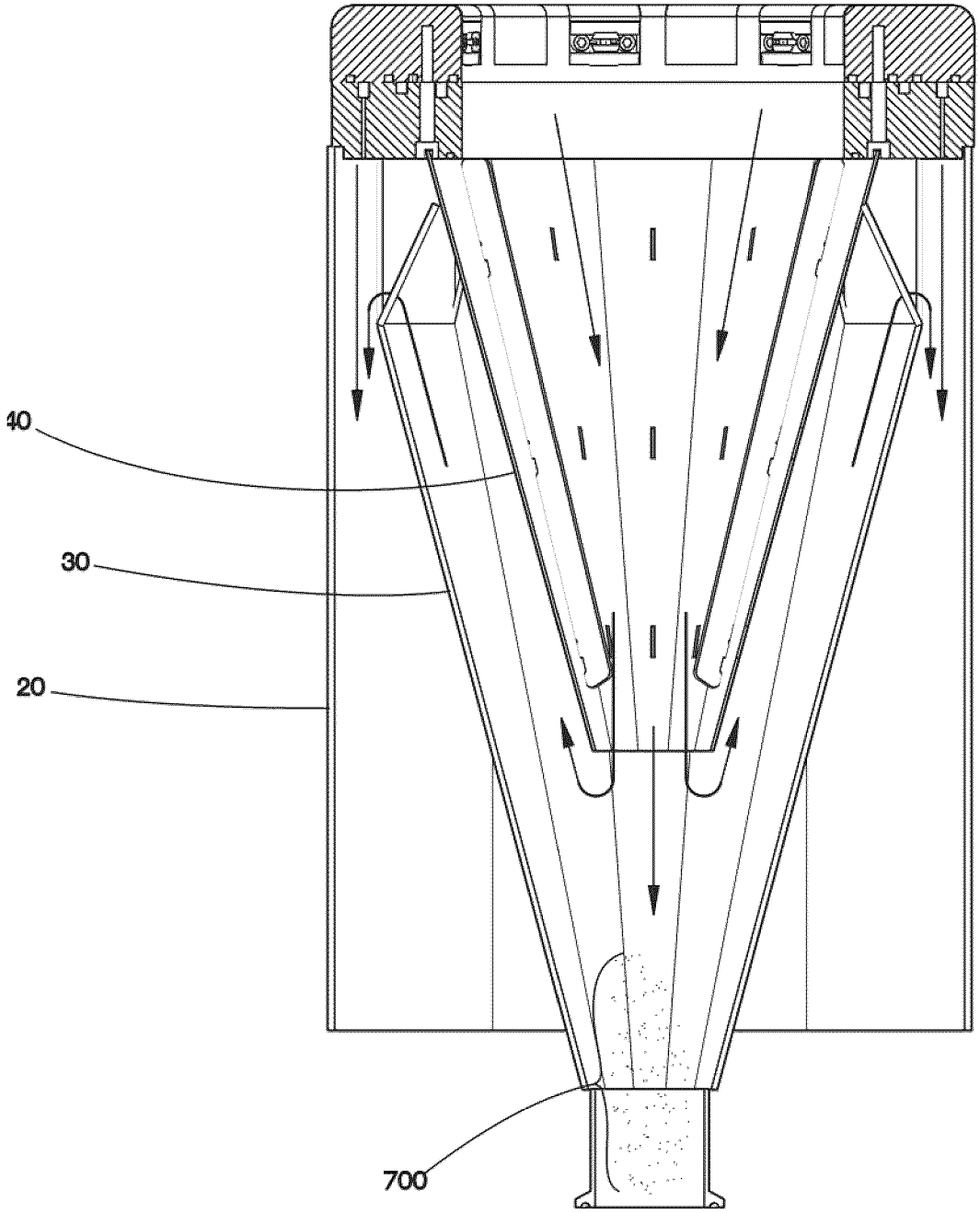
FIG. 6D is a view of a cross section of the device with air flow lines according to one embodiment.
Figure 6E:
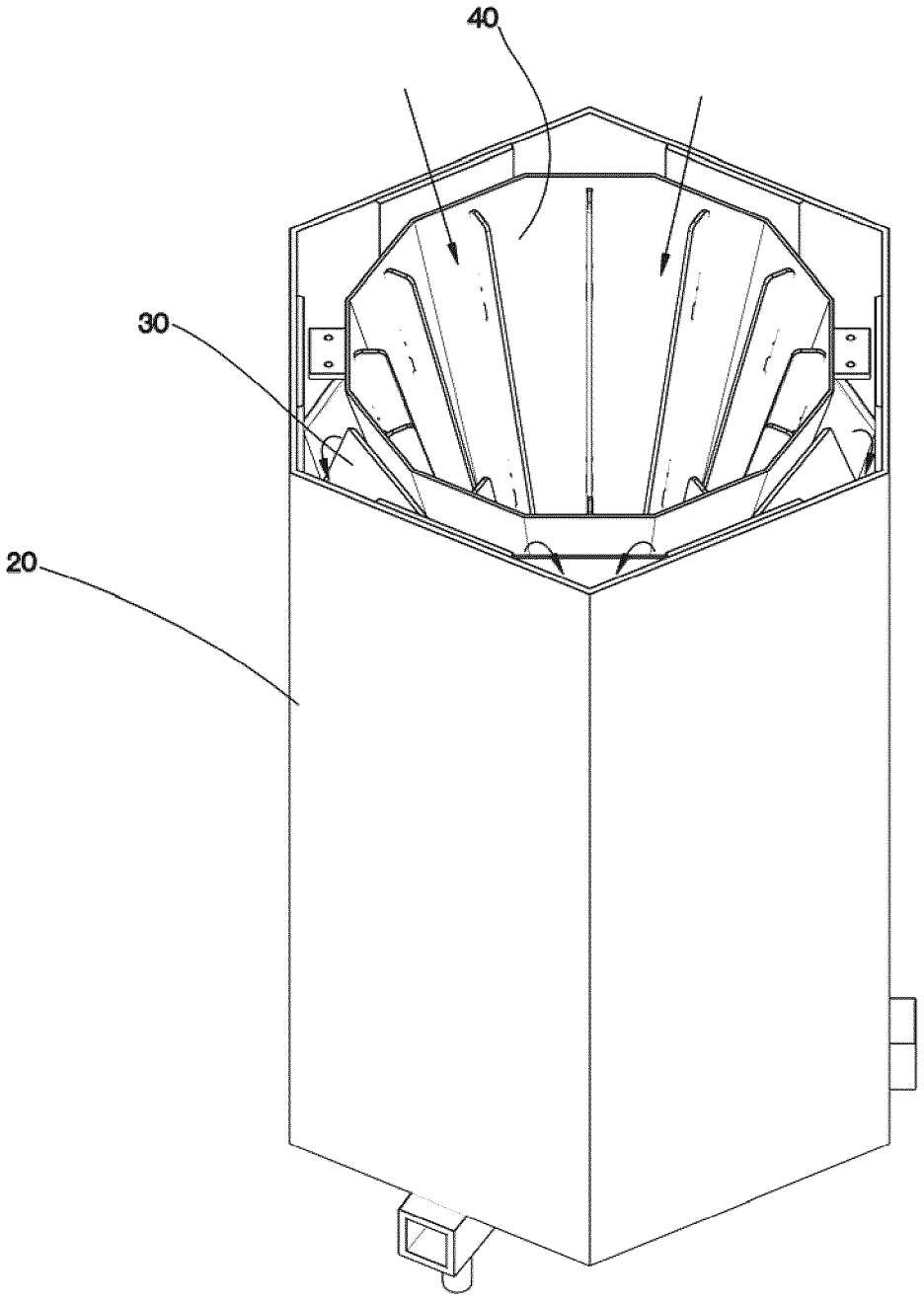
FIG. 6E is a view of the device without the cap with air flow lines according to one embodiment.

FIGS. 6C, 6D and 6E depict the device showing air being directed towards the drain as well as vacuum air blowing downwards along the space formed by the inside wall of the housing and the outside wall of the first liner 30. In this instance, air blown downwards between the first liner and the housing creates a vacuum effect (negative pressure) drawing air down through the second liner and up between the second and first liners. Heavy particulates 700 such as paint or the like removed from a spraying unit during the cleaning process and the solvent used in the process rotate and impact the inside wall and vanes of the second liner forming particulates 700. The additional corners and vanes in the second liner cause the liquids and VOCs to stop the rotation of the paint (impacting the velocity of paint removed from cap head and air stream) minimizing any VOCs, liquids and paint from moving upwards to the first liner and inside of the housing. These particulates 700 will fall to the bottom of the second liner towards the drain or will adhere to the inside of the second liner which may be easily cleaned at a later time. Any lighter particulates and vapourized solvent may be drawn upwards between the second and first liners and downwards between the first liner and housing to a scrubber, secondary waste recovery system or equivalent.

Figure 7A:
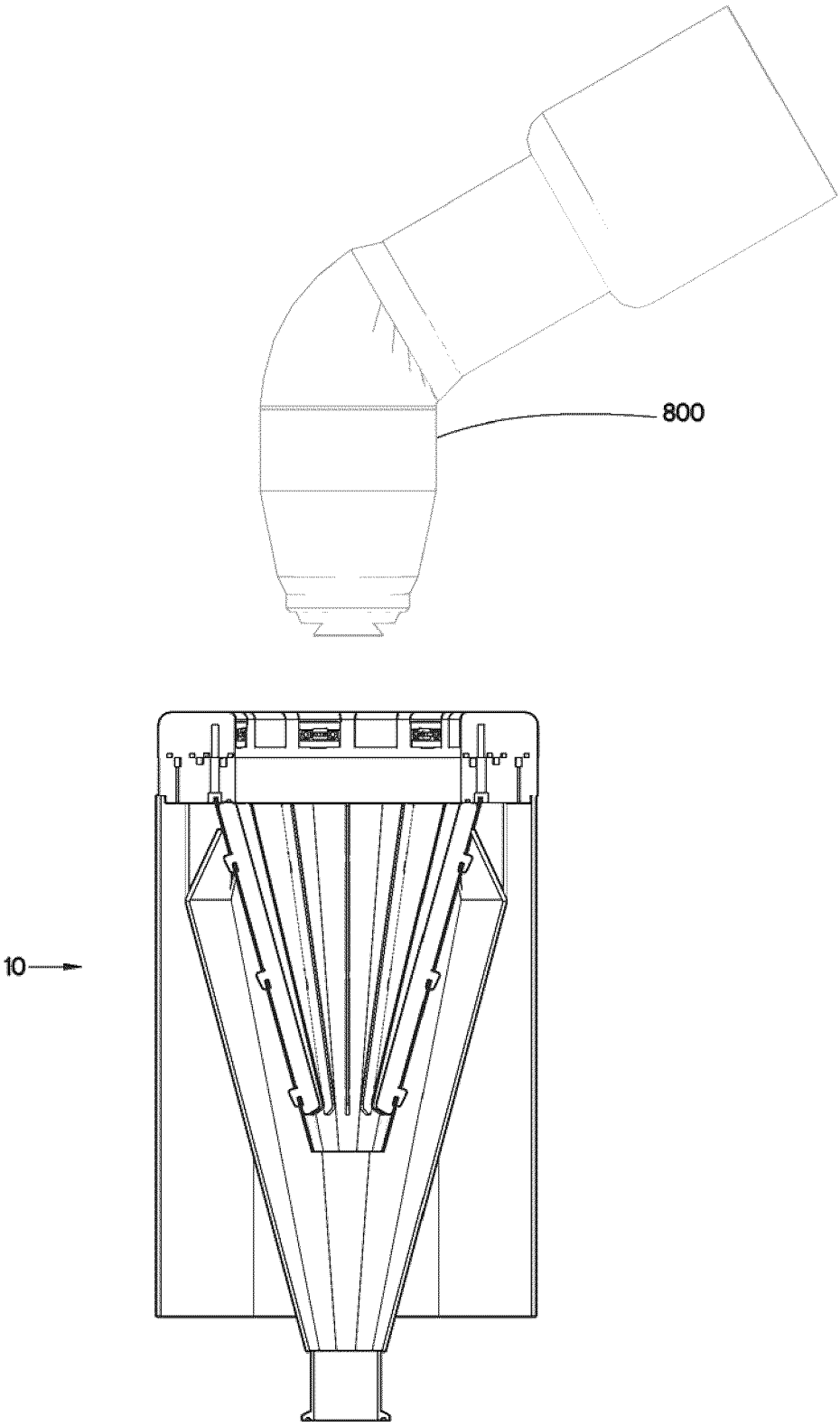
FIGS. 7A-7E is a view of the sequence of the device when cleaning and drying a spraying unit according to one embodiment.
Figure 7B:
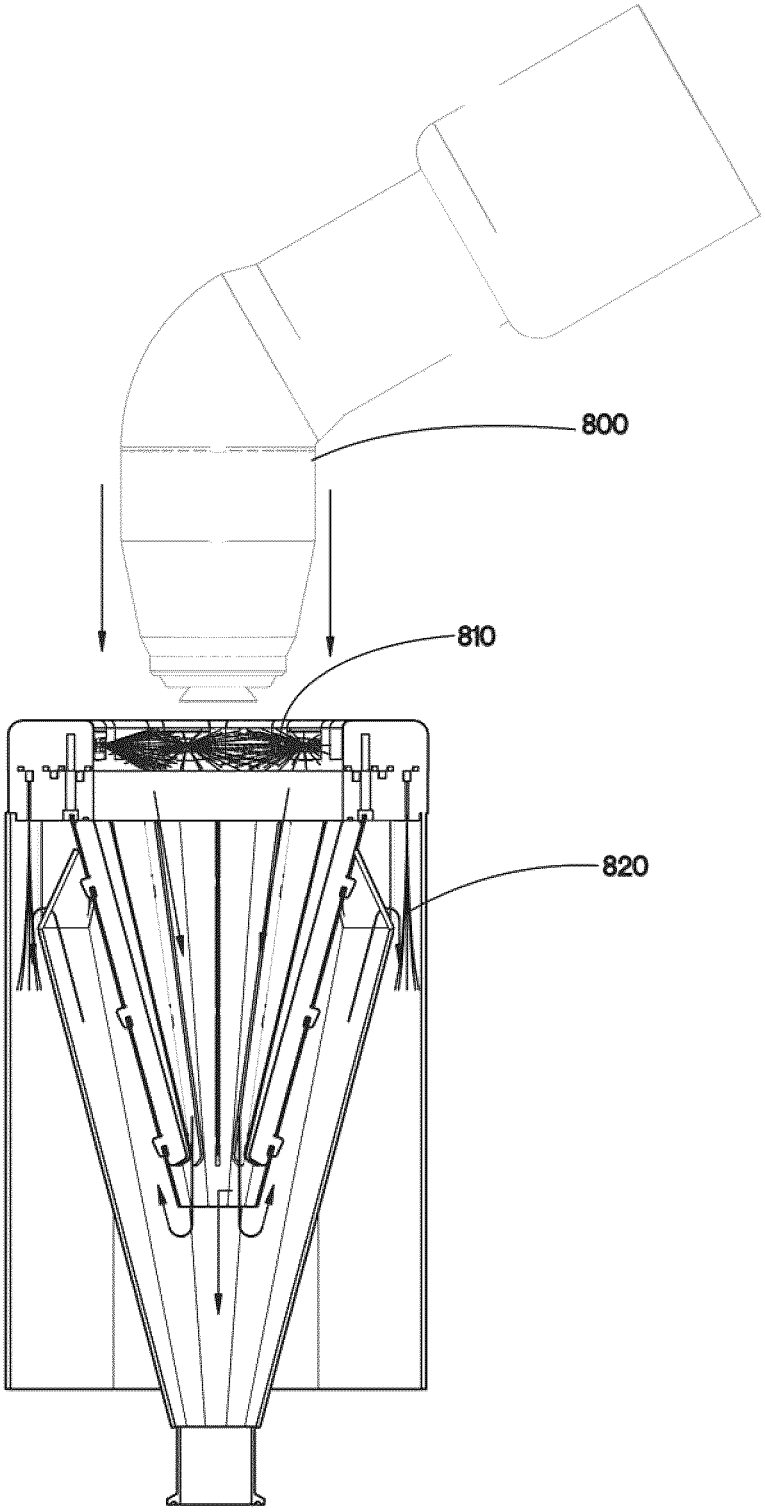
Figure 7C:
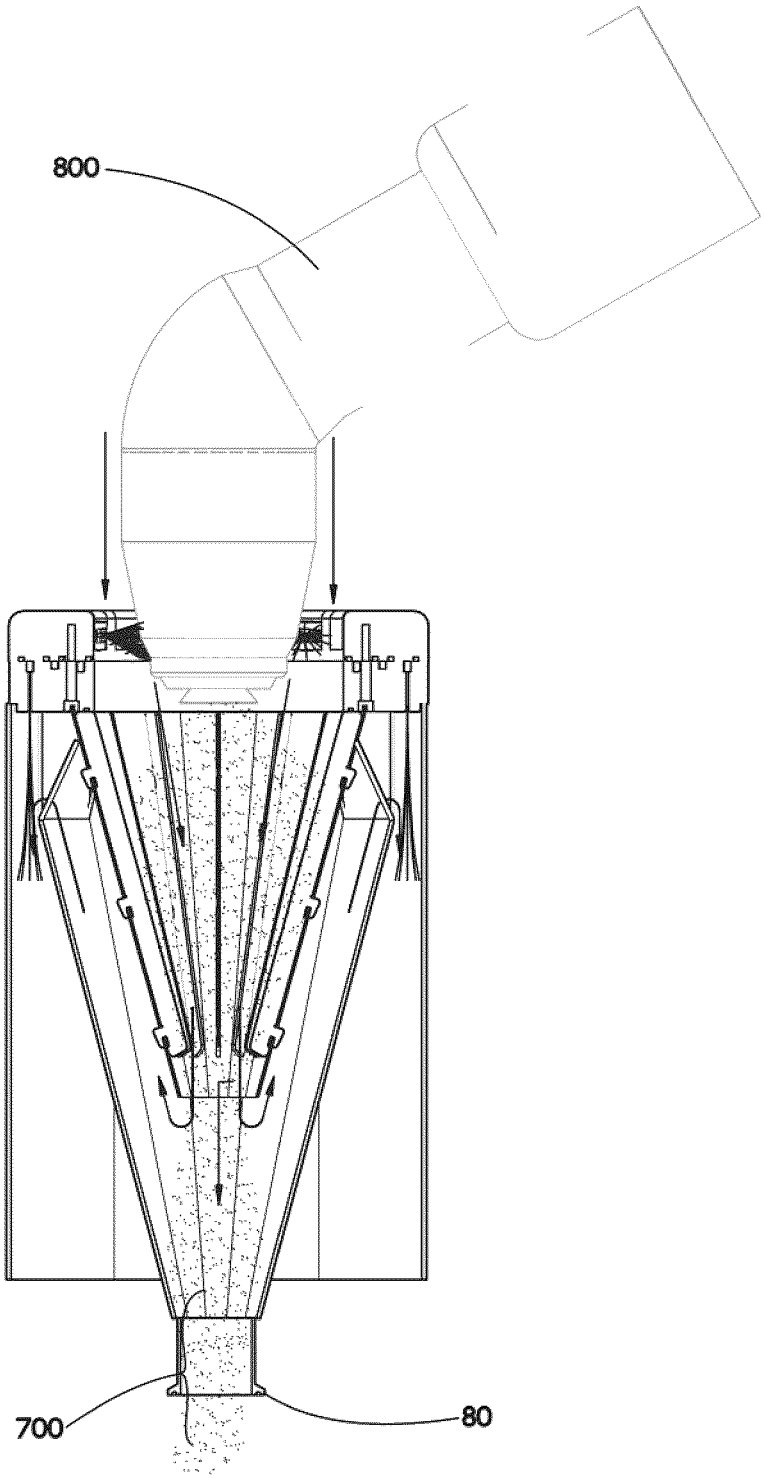
Figure 7D:
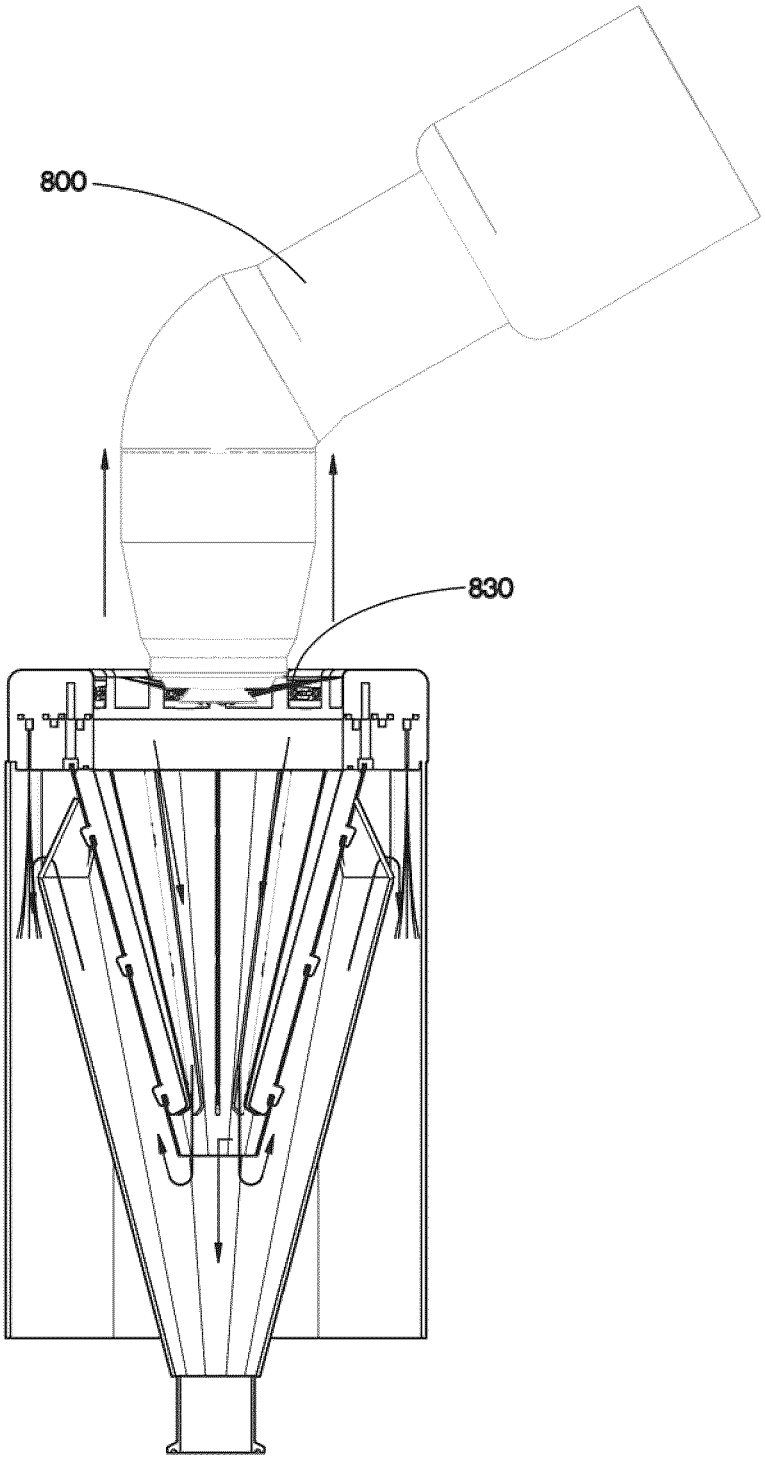
Figure 7E:
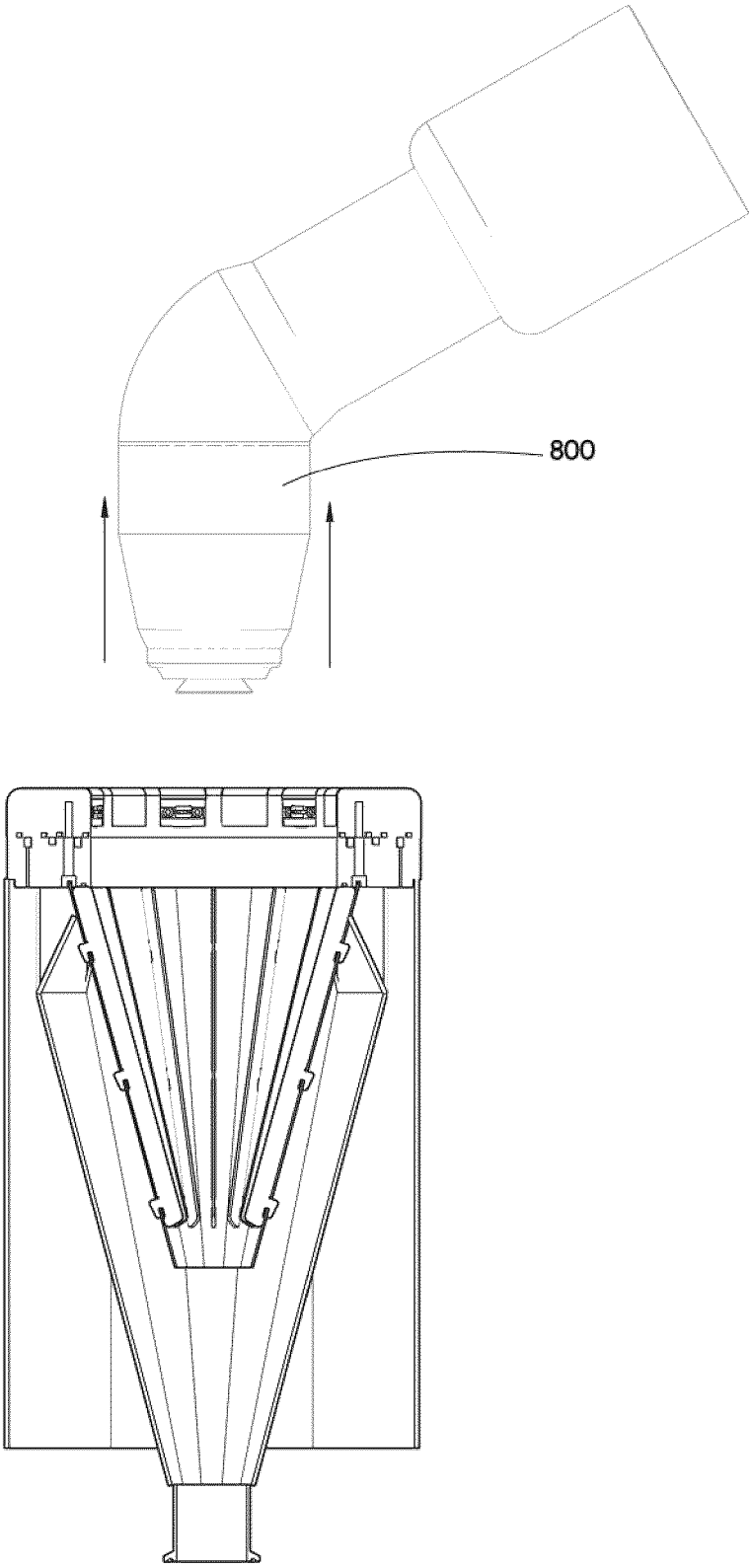

As best seen in FIGS. 7A-7E, there is depicted the cleaning and drying operation of a paint spraying unit 800 requiring cleaning. In FIG. 7A, the paint spraying unit 800 is situated proximate the opening of the cleaning and drying device 10. In FIG. 7B, the spraying unit 800 begins to be lowered into the opening with the solvent streams 810 and vacuum streams 820 actuated. In this instance, the vacuum streams 820 create a vacuum by directing air downwards thus urging solvent to be directed towards the bottom of the device 10. In FIG. 7C, the spraying unit 800 is partially lowered into the opening of the housing with the solvent spray cleaning the spraying unit and particulates 700 from the spraying unit 800 and solvent being directed downwards towards the drain 80. When the cleaning step is completed, the solvent streams 810 is closed, the cleaned spraying unit 800 is raised upwards towards the top end and the air streams 830 is actuated to dry the cleaned spraying unit 800 and direct any solvent downwards towards the drain 80. When the cleaned and dried spraying unit 800 leaves the top end of the housing, the air streams 830 and vacuum streams 820 are closed. The spraying unit is not required to make direct contact with the cleaning and drying device 10.

Figure 8:
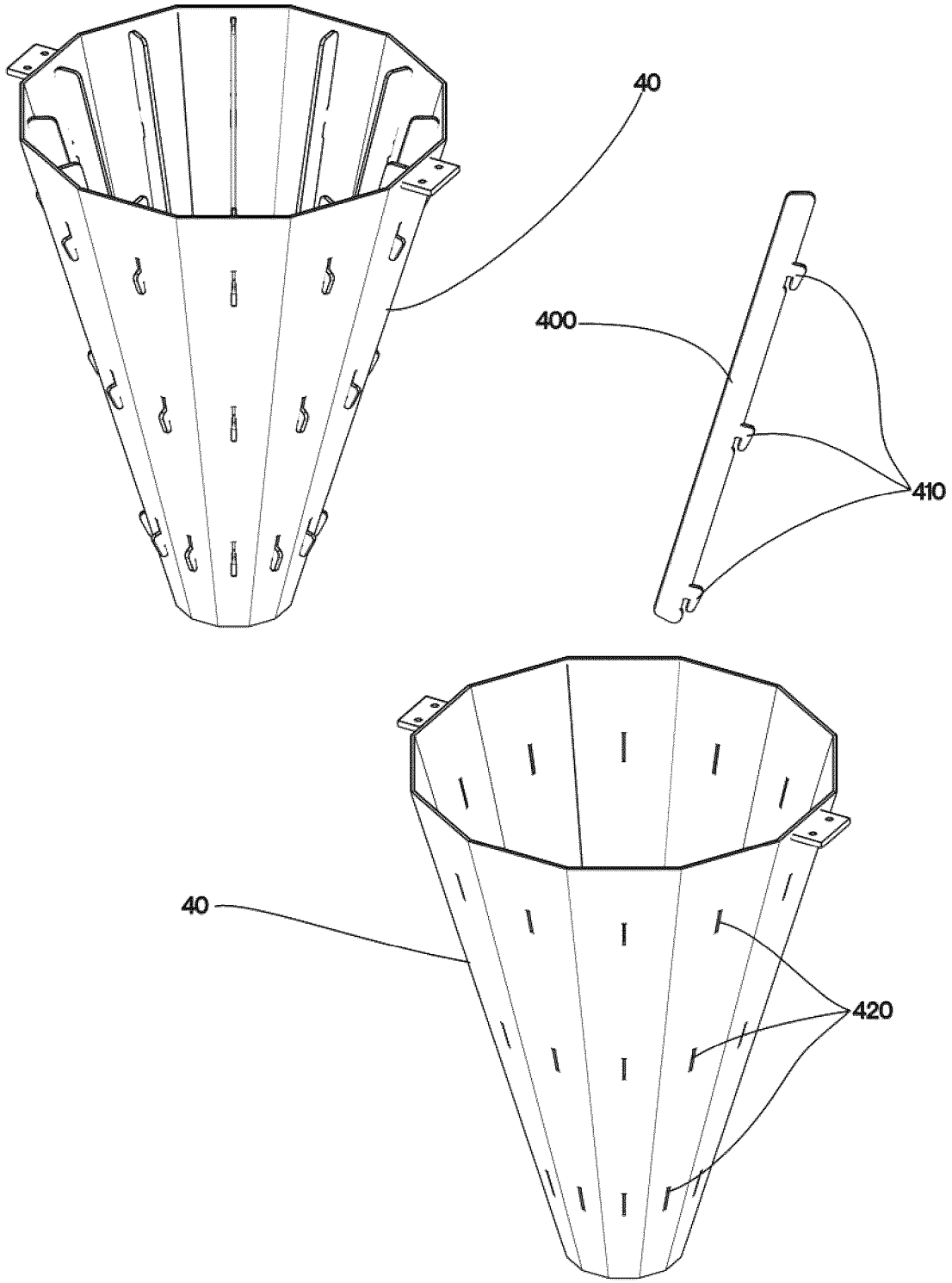
FIG. 8 is a view of the second liner with baffles (vanes) according to one embodiment.

Referring now to FIG. 8, there is depicted the second liner 40 with a plurality of elongated vertical vanes 400 connected to the inner wall of the second liner via vertical vane tabs 410 received in vane tab receivers 420 on said second liner (although the vanes may be integral with the second liner). In some instances, should vacuum control be required and/or desired, removable vertical vanes 400 may be added along the inside wall of the second liner 40 to regulate speed (e.g., slow down) of the air moving downwards along the inside of the second liner 40. The vertical vanes 400 may be from at least one, preferably a plurality, more preferably twelve, depending on the desired air flow control. If there are a plurality of vertical vanes, they are spaced apart from each other to facilitate air flow and speed control. Vertical vane length may vary depending on the desired condition.

Figure 9:
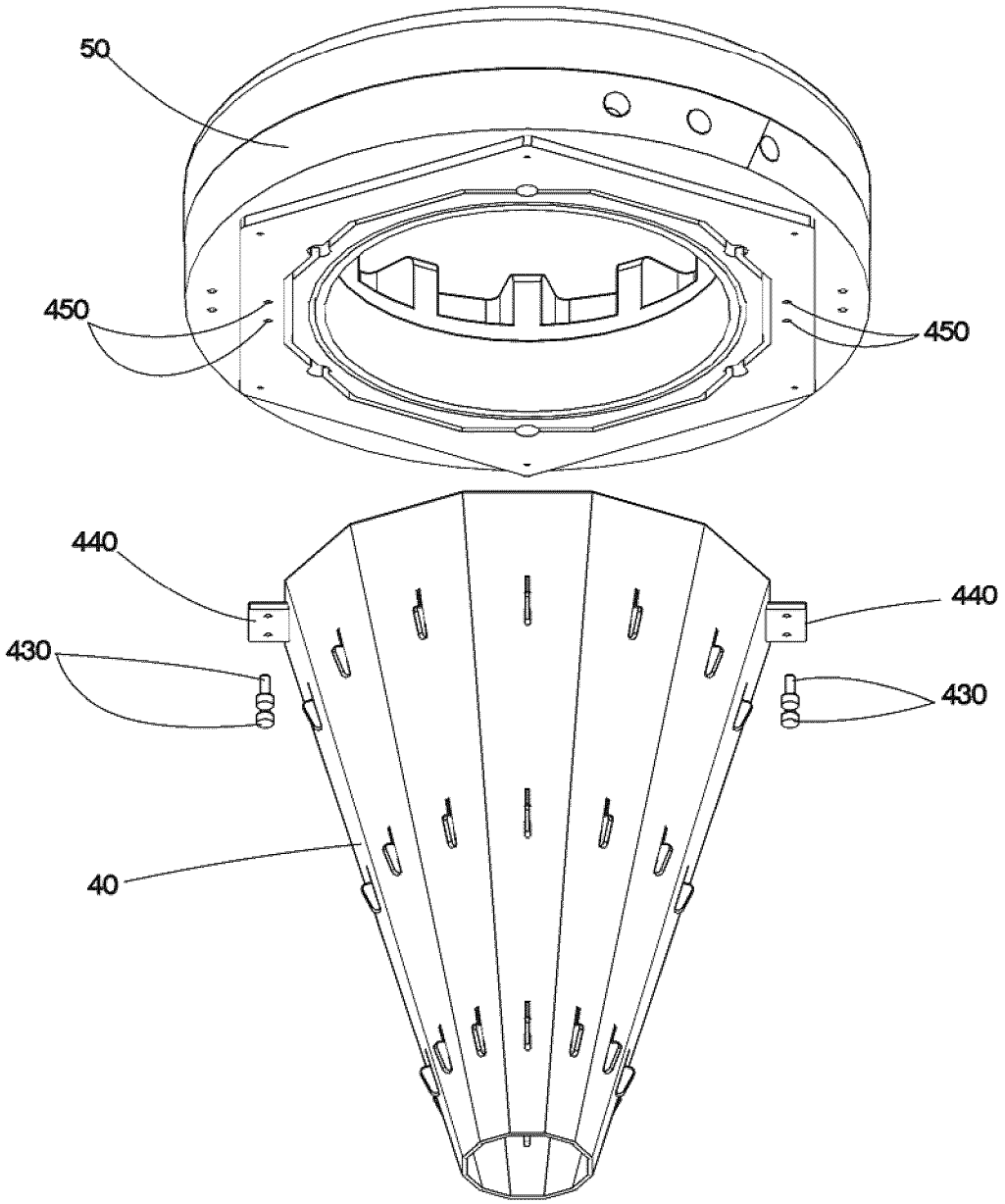
FIG. 9 is a view of the connection of the second liner to the annular cap according to one embodiment.

Referring now to FIG. 9, there is depicted a preferred connection of the second liner 40 to the bottom of the annular cap 50 via second liner screws 430 connecting two second liner tabs 440 extending radially outward from said second liner 40, to second liner screw apertures 450 on the bottom of the annular cap. This connection method facilitates removal if necessary as well as provides a secure connection (any suitable connection may be used).

Figure 10:
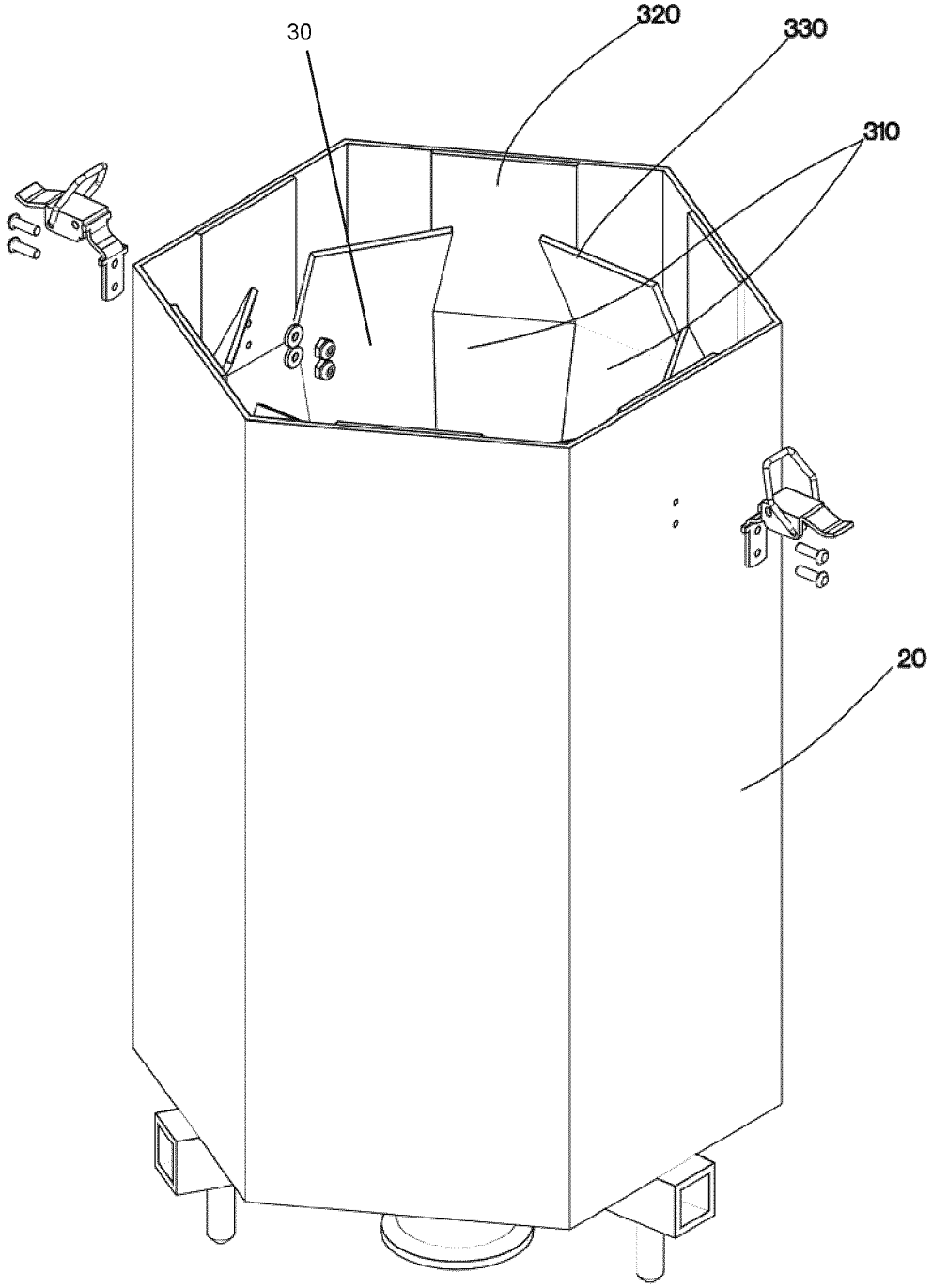
FIG. 10 is a view of the connection of the first liner to the housing and the cap connectors according to one embodiment.
Figure 11:
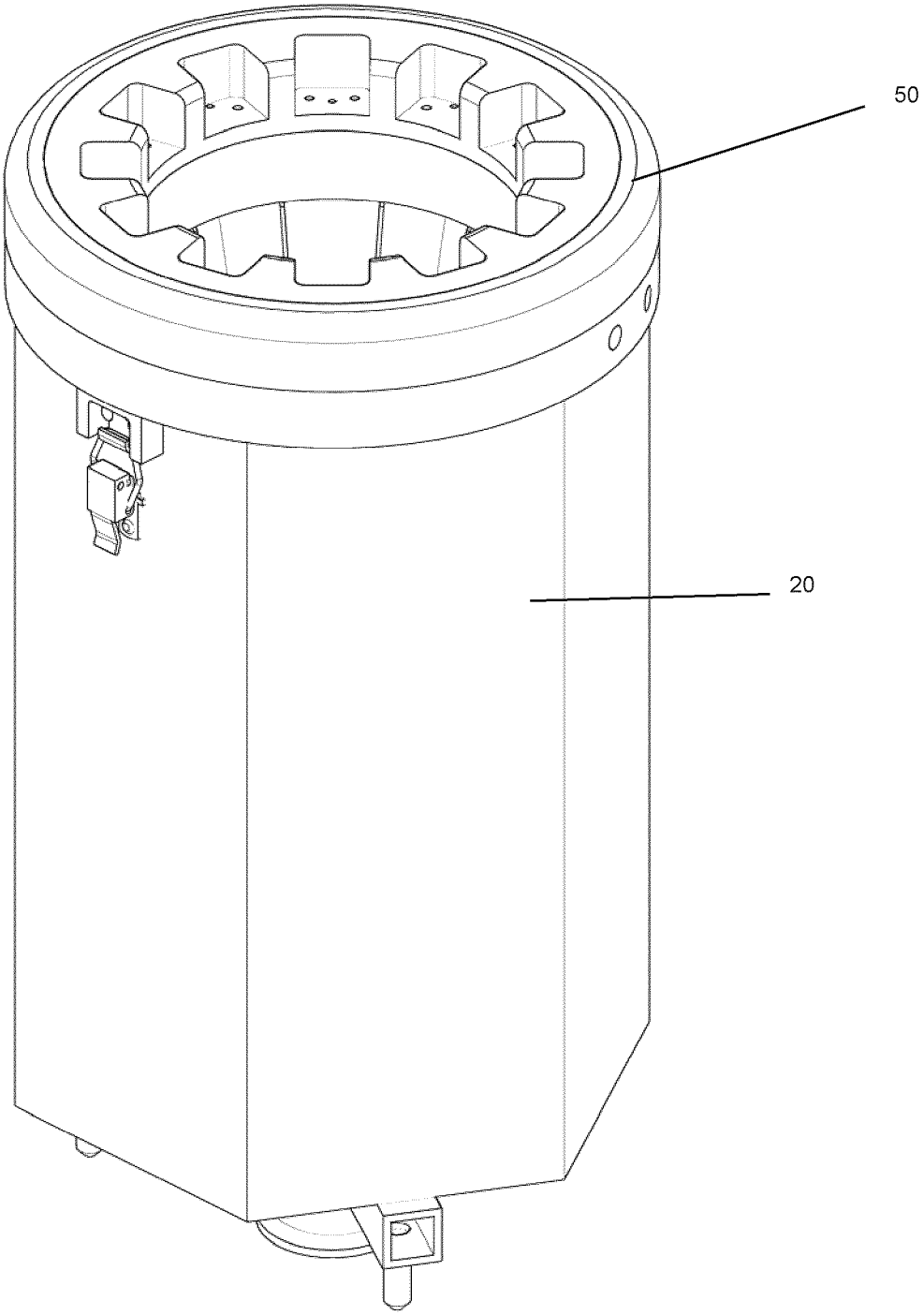
FIG. 11 is a view of the annular cap connected to the housing via cap connectors according to one embodiment.

Referring to FIG. 10, there is depicted the connection mode of the first liner 30 to the housing 20. As can be seen, the first liner 30 is comprised by a number of walls forming a dodecagonal cone. Proximate the top of the first liner 30, each dodecagonal wall 310 comprises a top tab. Each dodecagonal wall alternates with a top tab in angle with the adjacent top tab. In particular, one dodecagonal wall 310 includes a vertically oriented top tab 320. The adjacent dodecagonal wall includes an inwardly angled top tab 330. In other words, every other top tab is vertically oriented to rest against a wall of the hexagonal housing 20, allowing for a point to connect and secure the first liner 30 with the housing 20. This point also serves to secure the annular cap to the housing (see FIGS. 10 and 11). The remaining top tabs are inwardly angled towards the centre of the first liner 30 forming a space along the length of the vertex of each wall of said housing 20. The remaining top tabs angled inward towards the centre of the first liner 30 also serve to hold the second liner 40 in place by a portion of the outer wall of the second liner 40 resting against the top edge of angled inward top tabs, as well as allow air flow as desired.

Figure 12:
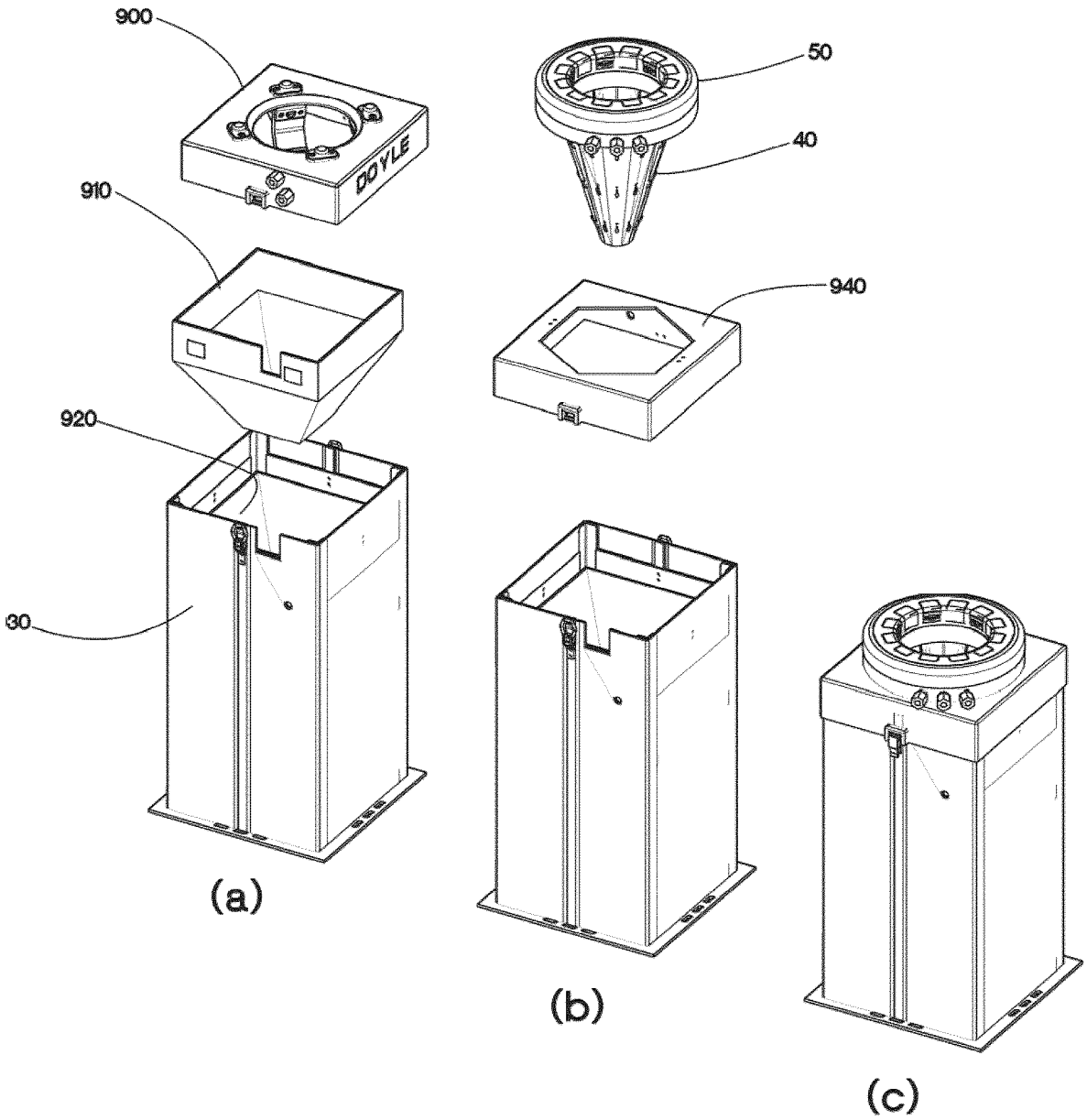
FIG. 12 is a view of a retrofit system according to one embodiment.

Referring now to FIG. 12, there is depicted the retrofitting of an existing cap cleaner 930 with the annular cap 50, =and second liner 40 disclosed herein. In this instance, the existing housing 930 and existing first liner 920 of the unit to be retrofitted will be used. As best seen in FIG. 12(*a*) an existing cap cleaner top cover 900 and inner liner 910 are removed. As best see in FIG. 12(*b*) keeping existing liner 920 in place, place retrofit lid 940 onto cap cleaner 930, adapted to accommodate hexagonal plate 180 of cap 50 and as best seen in FIG. 12(*c*) attach assembled cap 50 and second liner 40 (See FIG. 9) onto cap cleaner 930. Now an existing cap cleaner retrofitted with the assembled cap 50 and second liner 40 allows the existing cap cleaner to have three different streams (solvent, air and vacuum) with the associated benefits described herein.

As many changes can be made to exemplary embodiments of the disclosure without departing from the scope thereof; it is intended that all matter contained herein be considered illustrative of the invention and not in a limiting sense.

The invention claimed is:

1. A spraying unit cleaning and drying device, said device comprising: a top end and a bottom end;

said top end and said bottom end connected to each other by a housing; said housing having an spraying unit receiving opening proximate said top end, for receiving at least a portion of said spraying unit;

a first liner within said housing;

a second liner within said first liner;

said first liner fitting within said housing forming a space between an outside wall of said first liner and an inside wall of said housing;

said second liner fitting substantially within said first liner forming a space between an outside wall of said second liner and an inside wall of said first liner and running a substantial length of said second liner; said opening further comprising an open annular cap, proximate the top end; said device having at least one vacuum air supply influent port, at least one drying air supply influent port and at least one solvent supply influent port, at least one vacuum air supply channel in communication with said at least one vacuum air supply influent port, for supplying vacuum air to at least one vacuum air effluent port; at least one drying air supply channel, in communication with said at least one drying air supply influent port, for supplying drying air to at least one drying air effluent port, said at least one drying air effluent port is adjustable in flow direction of said drying air; at least one solvent supply channel in communication with said at least one solvent supply influent port, for supplying solvent to at least one solvent effluent port;

said at least one vacuum air effluent port flowing air downwards along the outside wall of said first liner and flowing in a direction away from said top end and towards said bottom end, thereby creating a vacuum within the device, drawing air through the top end of said device in a direction away from said top end, down along an inside wall of said second liner and upwards between the outside wall of said second liner and the inside wall of said first liner and downwards along the outside wall of said first liner drawing material and solvent towards and out a drain of the first liner proximate said bottom end; said at least one vacuum air effluent port situated on said top end, proximate said outside wall of said first liner and the outside wall of said second liner;

said at least one drying air effluent port providing air proximate said opening of said housing, flowing air in a direction towards said bottom end; said bottom end being open to the environment said first liner further comprising a plurality of base arms extending radially outward from said drain; each of said plurality of base arms further comprising a leg extending downward from each of said plurality of base arms; said bottom end of said housing supported by said plurality of base arms maintaining said bottom end open to the environment;

said at least one solvent effluent port providing solvent proximate said top end of said device, flowing solvent in a direction towards said bottom end.

2. The device of claim 1 further comprising a plurality of vacuum air effluent ports.

3. The device of claim 1 further comprising a plurality of drying air effluent ports.

4. The device of claim 2 further comprising a plurality of drying air effluent ports.

5. The device claim 1 further comprising a plurality of solvent effluent ports.

6. The device of claim 1, wherein said at least one drying air effluent port and said at least one vacuum air effluent port are proximate said open annular cap.

7. The device of claim 1, wherein said at least one solvent effluent port is proximate said open annular cap.

8. The device of claim 5, wherein each of a plurality of drying air effluent ports proximate said open annular cap alternate with each of said plurality of solvent effluent ports proximate said open annular cap.

9. The device of claim 1, wherein said housing is hexagonal in shape.

10. The device of claim 1, wherein said first liner is dodecagonal conical in shape.

11. The device of claim 1, wherein said second liner is dodecagonal conical in shape.

12. The device of claim 11 wherein said second liner further comprises at least one vane connected to the inside wall of said second liner.

13. The device of claim 11 wherein said second liner further comprises a plurality of vanes connected to the inside wall of said second liner.

14. The device of claim 12 wherein said at least one vane is vertically oriented along the inside wall of said second liner.

15. The device of claim 13 wherein said plurality of vanes are vertically oriented along the inside wall of said second liner.

16. The device of claim 1, wherein at least one surface of said device is smooth, reducing adherence of unwanted product, solvent or combinations thereof to a surface of said device.

17. The device of claim 1, wherein at least one surface of said device is treated, reducing adherence of unwanted product, solvent or combinations thereof to a surface of said device.

18. The device of claim 17 wherein said at least one surface is treated with polytetrafluoroethylene.

19. The device of claim 1, wherein at least one surface of said device is smooth and treated, reducing adherence of unwanted product solvent or combinations thereof to a surface of said device.

20. The device of claim 1, wherein said device is selected from stainless steel, coated steel, aluminum and combinations thereof.

21. A method of cleaning and drying a spraying unit, said method comprising:

i) providing a spraying unit cleaning and drying device according to claim 1;

ii) introducing the spraying unit to the spraying unit receiving opening of the device;

iii) supplying air from said at least one vacuum air effluent port and supplying solvent from said at least one solvent effluent port while moving the spraying unit downwards into the device;

iv) assessing cleanliness of the spraying unit;

v) stopping the supplying of solvent;

vi) supplying air from said at least one drying air effluent port; and vii) moving the spraying unit upwards out of the spraying unit receiving opening.

22. The device of claim 1 wherein said open annular cap is an open annular cap proximate a perimeter of said top end.

23. The device of claim 1 wherein said at least one solvent effluent port is adjustable in flow direction of said solvent.

24. The device of claim 1 wherein said at least one solvent effluent port is adjustable in volume of said solvent.

25. The device of claim 1 wherein said at least one vacuum air effluent port providing air along the outside wall of said second liner, flowing air in a direction away from said top end and towards said bottom end resulting in a vacuum within the device drawing air through the top end of said device in a direction away from said top end, down along the inside wall of said second liner; further drawing air up through the space formed between the outside wall of said second liner and the inside wall of said first liner and down through the space formed between the outside wall of said first liner and the inside wall of said housing out through the bottom end of said device.

* * * * *